US006243472B1

(12) United States Patent
Bilan et al.

(10) Patent No.: US 6,243,472 B1
(45) Date of Patent: Jun. 5, 2001

(54) FULLY INTEGRATED AMPLIFIED LOUDSPEAKER

(76) Inventors: Frank Albert Bilan, 2725 Castleton Dr., San Jose, CA (US) 95148; Jules Joseph Jelinek, 1329 Alabama St., San Francisco, CA (US) 94110

( * ) Notice: Subject to any disclaimer, the term of this patent is extended or adjusted under 35 U.S.C. 154(b) by 0 days.

(21) Appl. No.: 08/932,738

(22) Filed: Sep. 17, 1997

(51) Int. Cl.[7] ..... H04R 3/00; H04R 9/06

(52) U.S. Cl. ..... 381/117; 381/397; 381/401; 381/407; 381/412; 361/704; 29/594

(58) Field of Search ..... 381/159, 397, 381/117, 161, 164, 393, 394, 396, 410, 412, 433, FOR 159, 407, 400, 401; 29/594, 609.1; 361/704, 705, 706

(56) References Cited

U.S. PATENT DOCUMENTS

| | | | | |
|---|---|---|---|---|
| 3,499,988 | * | 3/1970 | Watanabe et al. | 179/1 |
| 3,941,932 | * | 3/1976 | D'Hoogh | 381/190 |
| 4,132,861 | | 1/1979 | Frieder et al. | 179/1 P |
| 4,220,832 | * | 9/1980 | Nagel | 179/115.5 PS |
| 4,255,815 | * | 3/1981 | Sauer et al. | 455/143 |
| 4,504,704 | * | 3/1985 | Ohyaba et al. | 179/115.5 |
| 4,559,584 | * | 12/1985 | Kuwahata et al. | 362/86 |
| 4,625,328 | * | 11/1986 | Freadman | 381/11 |
| 4,811,403 | * | 3/1989 | Henricksen et al. | 381/87 |
| 5,097,513 | * | 3/1992 | Jordan et al. | 381/160 |
| 5,524,283 | * | 6/1996 | Miyakawa et al. | 455/90 |
| 5,533,132 | * | 7/1996 | Button | 381/90 |
| 5,602,930 | * | 2/1997 | Walton | 381/192 |
| 5,796,853 | * | 8/1998 | Lee | 381/120 |
| 5,872,855 | | 2/1999 | Porrazzo et al. | 381/194 |
| 5,937,074 | * | 8/1999 | Carver | 381/395 |

FOREIGN PATENT DOCUMENTS

| | | | | |
|---|---|---|---|---|
| 2503828 U | * | 8/1976 | (DE) . | |
| 2629605 | | 1/1978 | (DE) | H04R/3/04 |
| 2853676 | | 6/1980 | (DE) | H04R/3/04 |
| 0486254A | * | 5/1992 | (DE) | H04R/9/06 |
| 29620689C1 | * | 7/1997 | (DE) | H04R/3/00 |
| 19620692 | | 8/1997 | (DE) | H04R/9/06 |
| 19620692C1 | * | 8/1997 | (DE) | H04R/9/06 |
| 0586075 | | 3/1994 | (EP) | H04R/1/02 |
| 0658064 | | 6/1995 | (EP) | H04R/3/00 |
| 55-037070 | | 3/1980 | (JP) | H04R/9/02 |
| 61-016696 | | 7/1984 | (JP) | H04R/3/04 |
| 6269089 | | 9/1994 | (JP) . | |
| 9070093 | | 3/1997 | (JP) | H04R/3/04 |

OTHER PUBLICATIONS

Glenn Ballou, "Handbook for Sound Engineers: The New Audio Encyclopedia", Howard D. Sams & Co., 1991, pp. 512, 515, 525.*

* cited by examiner

*Primary Examiner*—Xu Mei

(57) ABSTRACT

A fully integrated, low cost, amplified electro-acoustic loudspeaker is disclosed in which an amplifier circuit (30, 130, 230, 330, 930, 1030), radio-frequency receiver amplifier circuit (430, 530), optical receiver amplifier circuit (630, 730), or network based amplifier circuit (830) is directly mounted on the loudspeaker's magnetic assembly (105, 505, 705, 805), contained within the loudspeaker's moving assembly (20, 29, 629, 42, 45, 50, 65), or a combination thereof. The amplified loudspeaker's magnetic assembly (5, 105, 405, 505, 705, 805, 905, 1005) is utilized as an electro-magnetic interference shield and/or a heat dissipating element for the attached electronic circuitry. In selected embodiments of the amplified loudspeaker system, the former (42) containing voice coil (45) is additionally utilized for convection cooling of the amplifier circuit (30, 230) or receiver/amplifier circuit combination (430, 630).

100 Claims, 40 Drawing Sheets

FULLY INTEGRATED AMPLIFIED LOUDSPEAKER

BACKGROUND OF THE INVENTION

This invention relates to loudspeakers, and in particular, to electro-acoustic devices of the voice coil variety with built in amplification.

The desire to build a single assembly containing a loudspeaker and an amplifier has existed since the birth of audio electronics. Early attempts focused on creating lighter weight portable combination chassis units that could be placed anywhere to provide amplified sound. This type of unit, in reality, was bulky and quite heavy due to then available technologies, and is exemplified by Michael in U.S. Pat. No. 2,812,382.

With the miniaturization of electronic components came the desire to mount an entire power amplifier and related circuitry on the frame of a speaker. One of many such types of implementation is disclosed by Johnson et. al., in U.S. Pat. No. 5,164,991. In the Johnson patent, the goal was to provide variable amplification so as to permit a number of different types of line level signals to be connected to the amplifier rather than addressing the miniaturization and compacting issues of design. Another example is outlined in U.S. Pat. No. 3,499,988, where the speaker frame provides an area for mounting an associated amplifier circuit. The resulting amplifier/speaker assembly is easily accessible for servicing while taking advantage of the speaker frame for heat sinking the miniature electronic components appropriately. However, the components are not self contained with in the loudspeaker itself, electromagnetic interference (EMI) radiating components cannot be easily shielded at low cost. In U.S. Pat. No. 4,625,328, Freadman provides a less fragile more bulky amplifier loudspeaker combination by enlarging the speaker frame and integrating a traditional adaptation of a thin type heat sink which relies on the motion of the diaphragm to generate airwaves to cool the heat sink/amplifier structure. However, once again there is no easy way to inherently shield EMI radiating components within the assembly provided.

Another similar but different approach was undertaken by Jordan in U.S. Pat. No. 5,097,513 where both the loudspeaker and amplifier, as well as the enclosure are placed at opposite ends of a reflex duct to improve cooling while increasing base response. But this and similar arrangements do not inherently provide a way of achieving near zero length wiring connections between the loudspeaker and the amplifier/driver circuitry, providing EMI shielding for any EMI radiating components or reducing manufacturing costs. More recently, assemblies have been built where one or more loudspeakers have been placed in an enclosure with amplification stages and in some cases include either an optical or wireless radio-frequency receiver. While the prior art addresses various combinations of known technical issues, none address, greatly reduce or actually eliminate the cost of building and manufacturing multiple assemblies, the cost associated with heat dissipating hardware, the need to shield electromagnetic radiating components, as well as, other related technical issues.

SUMMARY OF INVENTION

Amplified loudspeakers built according to the present invention are fully integrated assemblies wherein the amplifier is physically embedded into the loudspeaker's voice coil or magnetic housing assembly and is not externally visible. The first general way of practicing the current invention is to assemble the amplifier and any related circuit using thick or thin film hybrid techniques or miniature printed circuit board techniques and integrating the assembly as a part of the loudspeaker's voice coil. Using these techniques, the amplifier would directly drive the voice coil with little or no lead length. Power and line level audio signals would be brought to the cone of the loudspeaker according to the current invention using standard tinsel wire connections. In the case of wireless signal transmission, only power and ground would nominally need to be brought to the loudspeaker's cone. In the case of optical signal transmission, the voice coil assembly would also contain an optical sensor. In the case of Radio Frequency transmission, an antenna could be integrated into the cone of the loudspeaker. Further, the amplifier would be cooled by the turbulent air circulated within and without the voice coil assembly during the mechanical movements associated with the production of audible sound.

The second general way of practicing the current invention is to assemble the amplifier once again using miniature circuit assembly techniques and this time placing the assembly preferably within the internal magnetic cavity of the loudspeaker. Voice coil connection to the amplifier would now be internal using standard tinsel wire. Power and line level audio signal would be brought inside the housing of the loudspeaker to the amplifier using through-hole connections. In the case of wireless signal transmission, only power and ground would nominally need to be brought to the amplifier assembly. In the case of infrared signal transmission, a means would be provided for optical signals to be transferred to the amplifier assembly using an optical link. In the case of radio frequency signaling, a miniature antenna could be placed at the back of the magnetic assembly. In this case, the amplifier would be conduction cooled by attachment of the circuit assembly to the surface of the loudspeaker's magnetic assembly.

Depending on the type of amplifier circuit utilized in an embodiment of this invention, there can be further added advantages. For example, if a class D amplifier were to be used, this invention provides distinct and unique advantages. A primary advantage is the ability to integrate the output stage filter inductor or inductors into the voice coil assembly. A further advantage is the virtual absence of EMI due to the inherent shielded construction of the traditional loudspeaker assembly. An additional advantage that class D amplifiers provide is the much higher and more efficient (approximately 90 percent) output drive capability provided. Thus, higher audio output power can be integrated into the voice coil assembly given similar amount of thermal energy to be removed than is possible using traditional linear amplifiers such as a class B amplifier, etc. The present invention is ideally suited to class D for the above reason and the inherent EMI shielding provided which are a bane to the high fidelity industry at present requiring expensive passive filtering.

In embodiments of the present invention where a class D or other high power efficiency type amplifier circuit is utilized, the resulting amplified loudspeaker systems are ideally suited for automotive applications. In addition, the present invention also solves the age old automotive industry problems of finding space for placing and housing the amplifier circuitry, associated wiring issues, heat dissipation.

Regardless of the type of amplifier utilized in an embodiment of the present invention, a further advantage is that the amplifier does not have to drive a pair of variable length heavy gage speaker wires. This allows the amplifier to be optimized for near zero length speaker wires and matched to the loudspeaker voice coil dynamic characteristics.

In summary, the present invention has many advantages over the prior art. Among those advantages are:

(a) a lower cost electronic assembly;

(b) a very compact amplified loudspeaker system;

(c) inherent shielding and solving of EMI issues;

(d) elimination of most heat sinking associated costs;

(e) allowing for optimal matching of the amplifier/driver electronics to the characteristic of the loudspeaker's voice coil;

(f) allowing for easy addition of various electronic circuitry and amplification stages to improve the linearity of the entire amplified loudspeaker;

(g) the realization of a near zero length electronic voice coil connection; and (h) the elimination of heavy gage speaker wires.

DRAWING FIGURES

The object and features of the present invention, as well as various other features and advantages will become apparent when examining the description of various selected embodiments taken in conjunction with the accompanying drawings in which.

DETAILED DESCRIPTION OF SAMPLE EMBODIMENTS

Many embodiments of the present invention are technologically possible and taught by the text of this patent.

Figure 1:
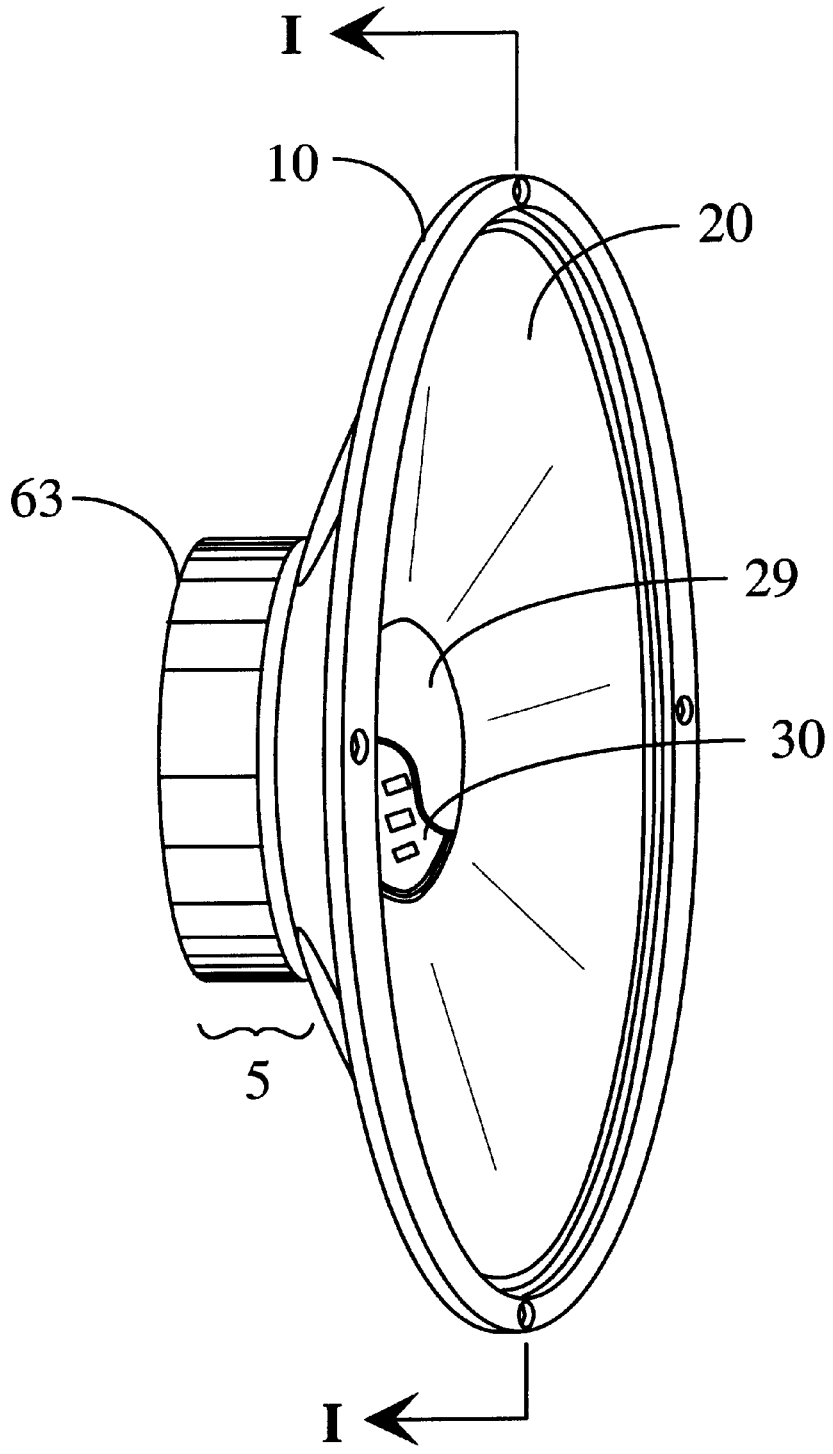
FIG. 1 is an overall isometric view of a first embodiment of the present invention.
Figure 2:
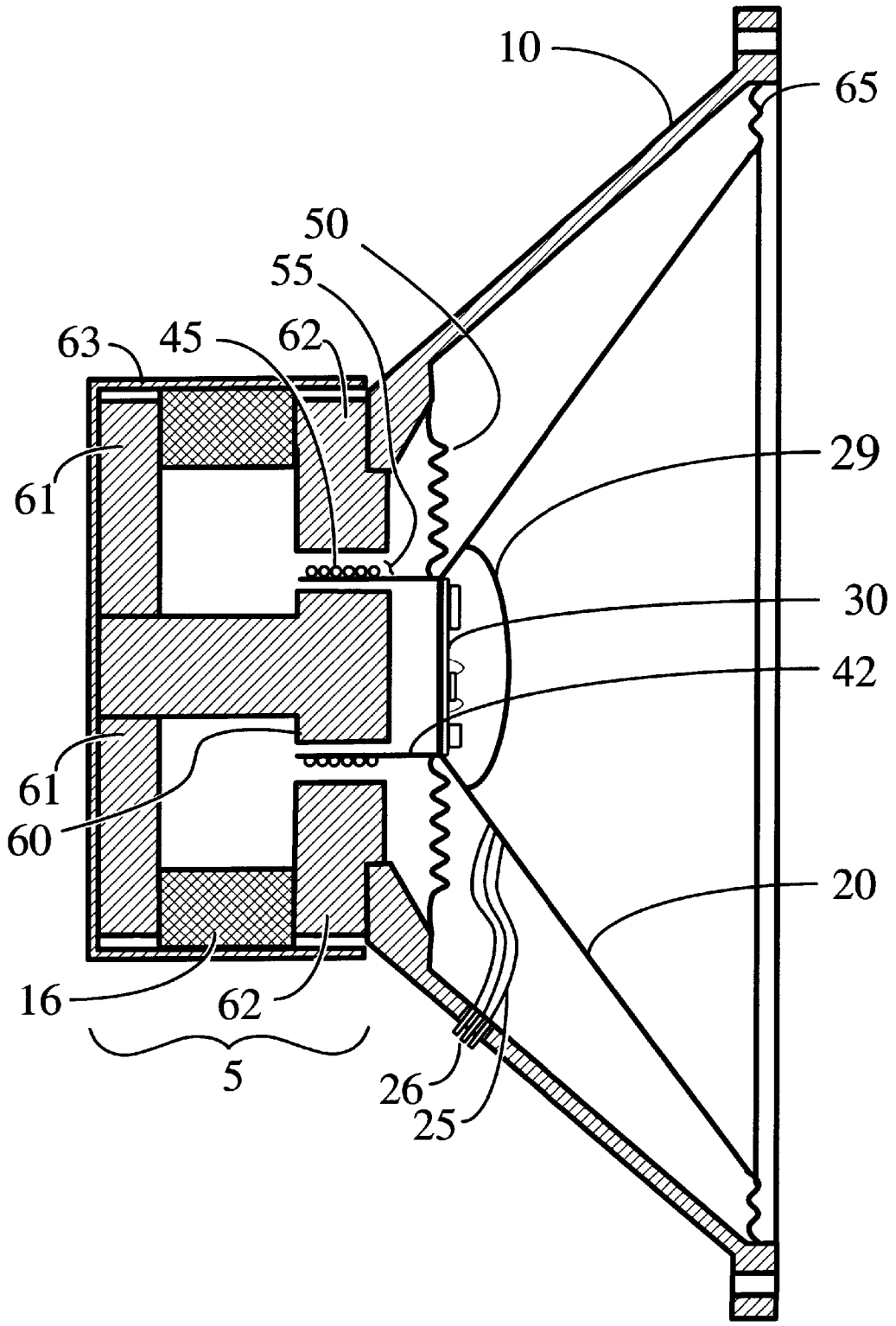
FIG. 2 is a cross sectional view of the first embodiment of the present invention through section II.

The first sample embodiment of the present invention is shown in FIG. 1, FIG. 2, FIG. 3 and FIG. 4. In FIG. 1 and FIG. 2, a loudspeaker frame assembly, 10, is shown which is similar to one of the many conventional designs known to the art. Loudspeaker frame assembly, 10, is physically attached to magnetic assembly, 5, consisting of annular axially oriented magnet, 16, center pole piece, 60, back plate, 61, front plate, 62, and magnetic shielding cover, 63. Attached to the inner surface of loudspeaker frame assembly, 10, is speaker cone, 20, supporting former, 42. Voice coil, 45, is then wound around former, 42 with amplifier circuit 30, mounted at the front end of former, 42.

Although amplifier circuit, 30, was arbitrarily mounted on the front end of former, 42, component side up, it could have just as easily been mounted component side down. Similarly, amplifier circuit, 30, could be manufactured with components mounted on both sides. Amplifier circuit, 30, is then covered by an air permeable voice coil dust cover, 29. During operation of the amplified loudspeaker, the movement of the voice coil, 45, causes violent air turbulence both over and under former, 42, which cools both the voice coil, 45, and amplifier circuit, 30.

Former, 42, can also be constructed of thermally conductive materials, such as, copper plated fiberglass, copper plated polyamide, aluminum, beryllium, etc, with the amplifier circuitry thermally bonded to former, 42. This would increase the total surface area violently agitated by the movement of speaker cone, 20, resulting in greater power dissipation capabilities.

Prior to attachment of voice coil cover, 29, connection is made from amplifier circuit, 30, to voice coil, 45. Supporting voice coil, 45, and speaker cone, 20, is spider, 50, and flexible cone support, 65, which are attached to loudspeaker frame assembly, 10. This makes it possible for voice coil, 45, to be positioned so that it rides in magnetic gap, 55. Power and appropriate audio input signal is provided to amplifier circuit, 30, via conventional loudspeaker tinsel wires, 25, to connector, 26. Similarly, it should be stated that power could have also been provided through other conductive means, such as providing a conductive spider assembly, etc. and not utilizing conventional tinsel wire. It is obvious to those in the loudspeaker industry that it would also be possible to use a combination of both techniques.

Figure 3:
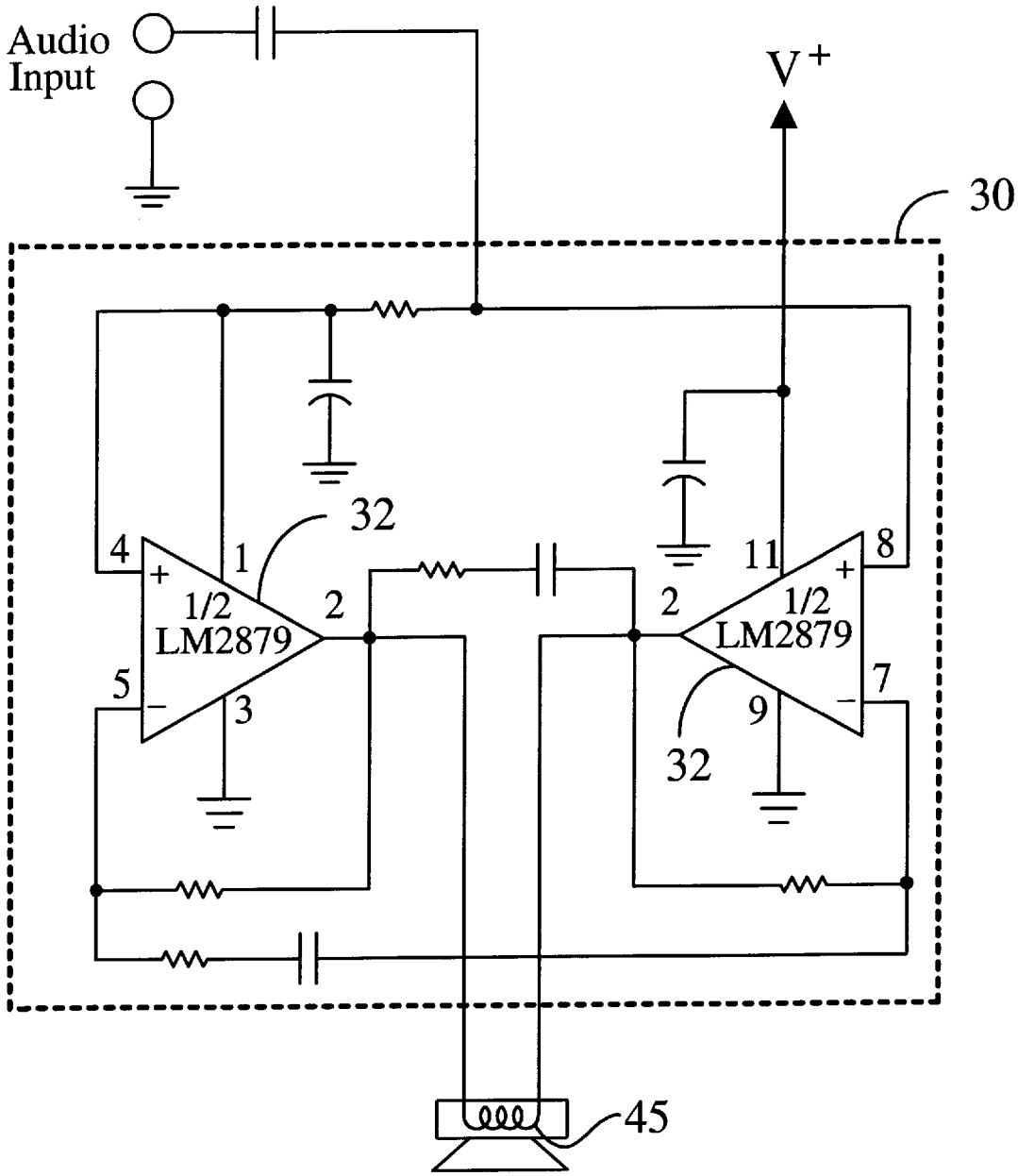
( PRIOR ART ) Fig. 3
FIG. 3 is a schematic representation of the electronic circuitry utilized in the first and second embodiments of the present invention.

A schematic representation of the circuitry associated with the first embodiment of the present invention is outlined in FIG, 3. FIG. 3 shows a traditional amplifier circuit, 30, utilizing integrated circuit, 32, connected in a class B bridge configuration along with other passive components driving voice coil, 45. Although a class B amplifier in a bridge configuration was chosen to eliminate large size electrolytic capacitors, it is possible to substitute other types or classes of amplifier circuit in any embodiment of the present invention.

Figure 4:
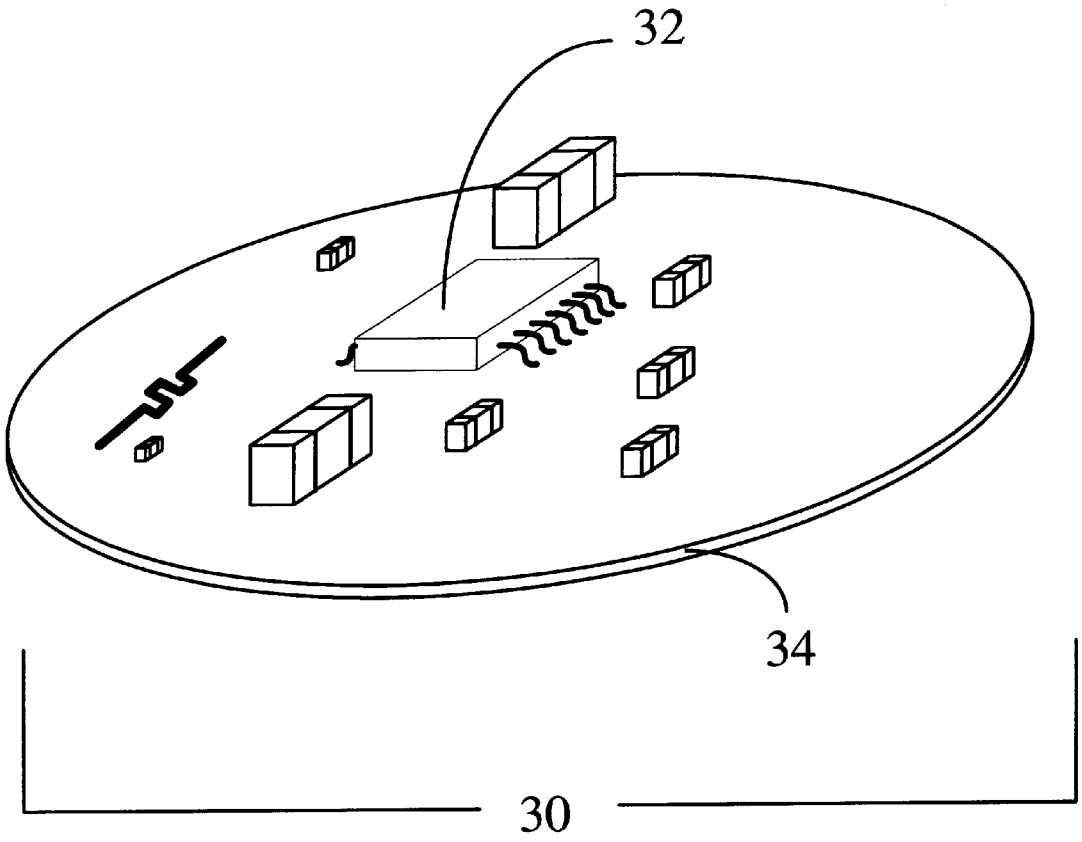
FIG. 4 is an isometric view of the amplifier circuit according to the first embodiment of the present invention.

Similarly, FIG. 4, shows a pictorial representation of amplifier circuit, 30. This particular embodiment of the present invention utilizes a very light and thermally conductive substrate material, 34, such as, Beryllium. The conductive substrate material, 34, is then overcoated on the component side with an appropriate insulating film or material followed by suitable metalization and the creation of electrically conductive traces and component pads.

Additionally, the substrate could be made of more conventional materials, such as Alumina (Al203), or Beryllium Oxide (BeO), or printed circuit materials, such as FR4 glass epoxies, or polyamide glass epoxies. This and a myriad of other suitable micro-electronic circuit assembly technologies that are well known to the thick or thin film, printed circuit board and hybrid areas of the electronics industry could likewise be successfully used in any embodiment of the present invention.

To those in the art it is also obvious that the materials selected would be a trade-off between cost and the final mass of the loudspeaker's moving assembly, containing, former, 42, voice coil, 45, spider, 50, amplifier circuit, 30, loudspeaker dust cover, 29, speaker cone, 20, and flexible cone support, 65.

Figure 5:
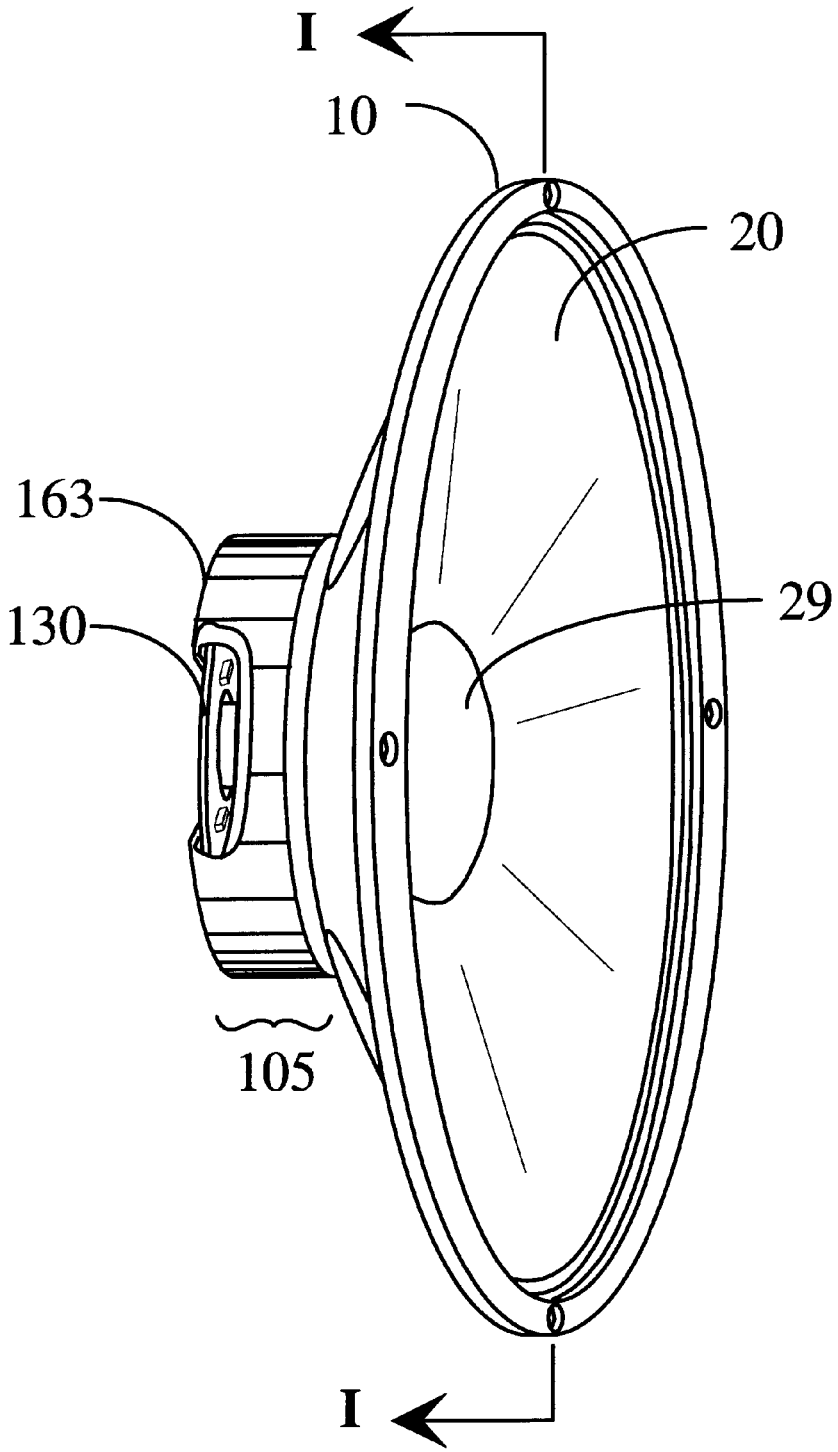
FIG. 5 is an overall isometric view of a second embodiment of the present invention.
Figure 6:
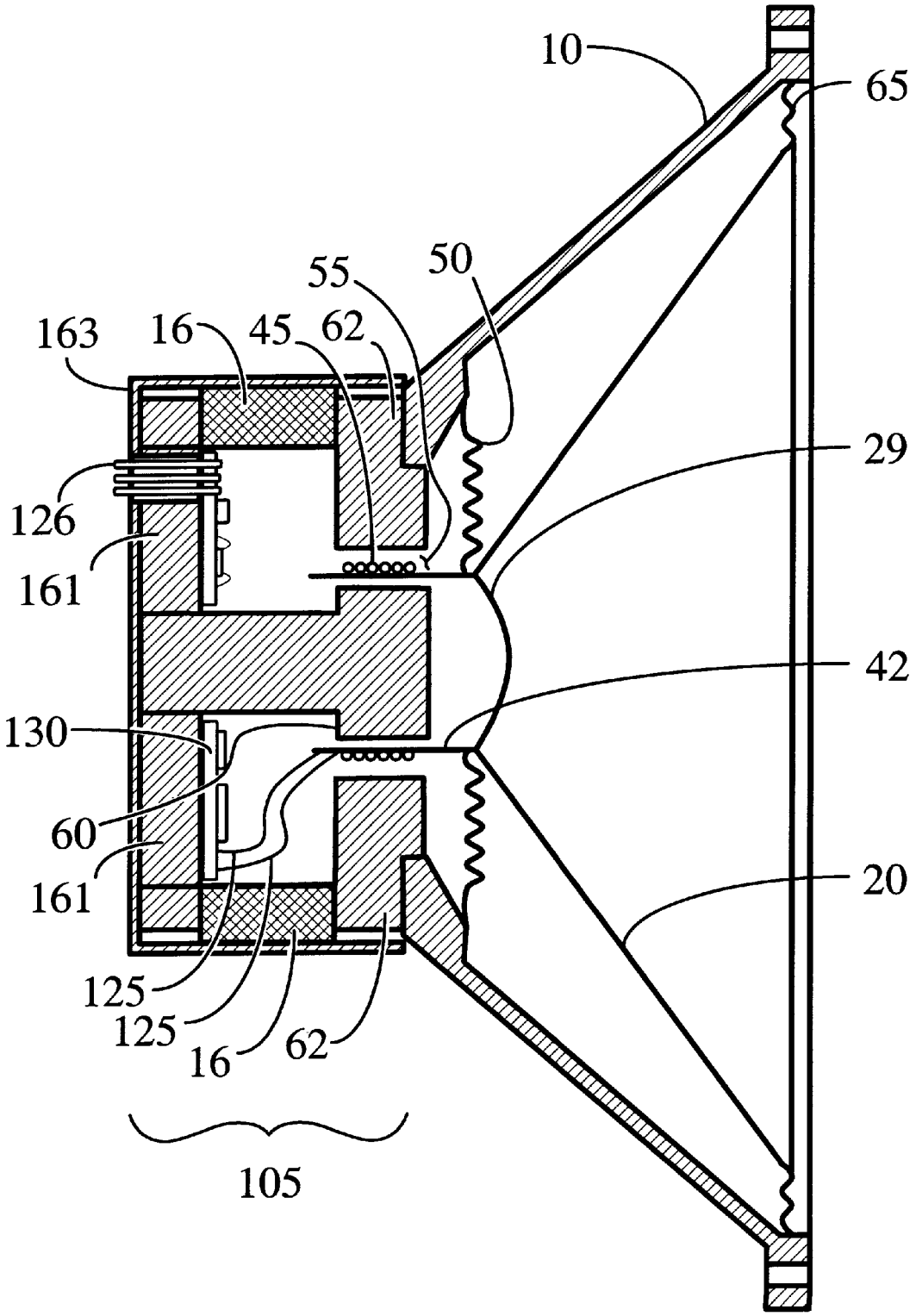
FIG. 6 is a cross sectional view of the second embodiment of the present invention through section II.
Figure 7:
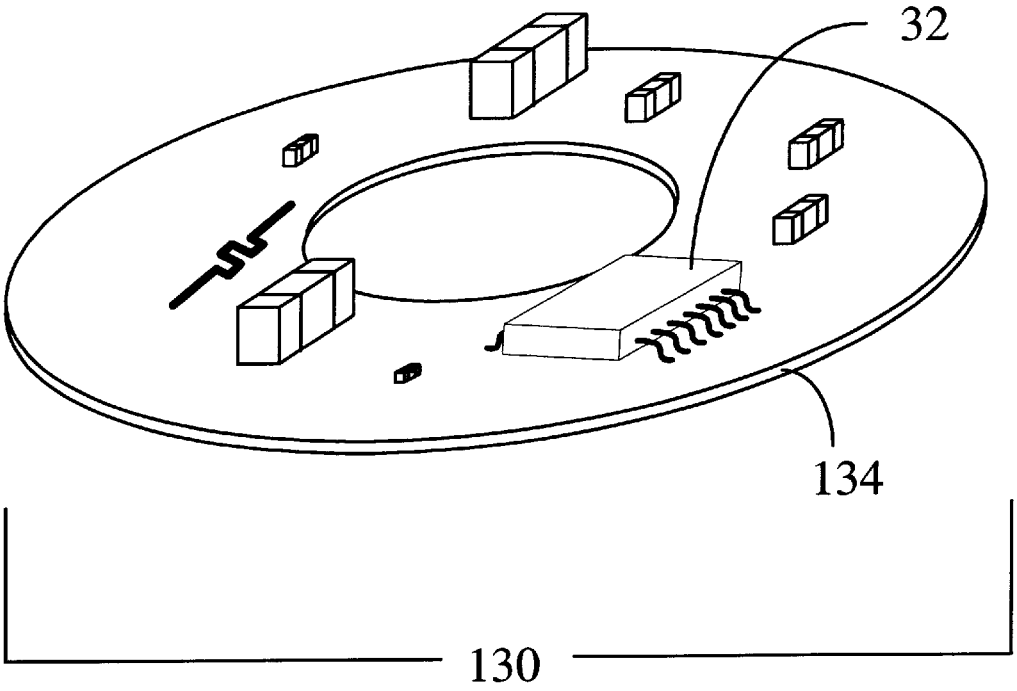
FIG. 7 is an isometric view of the amplifier circuit according to the second embodiment of the present invention.
Figure 8:
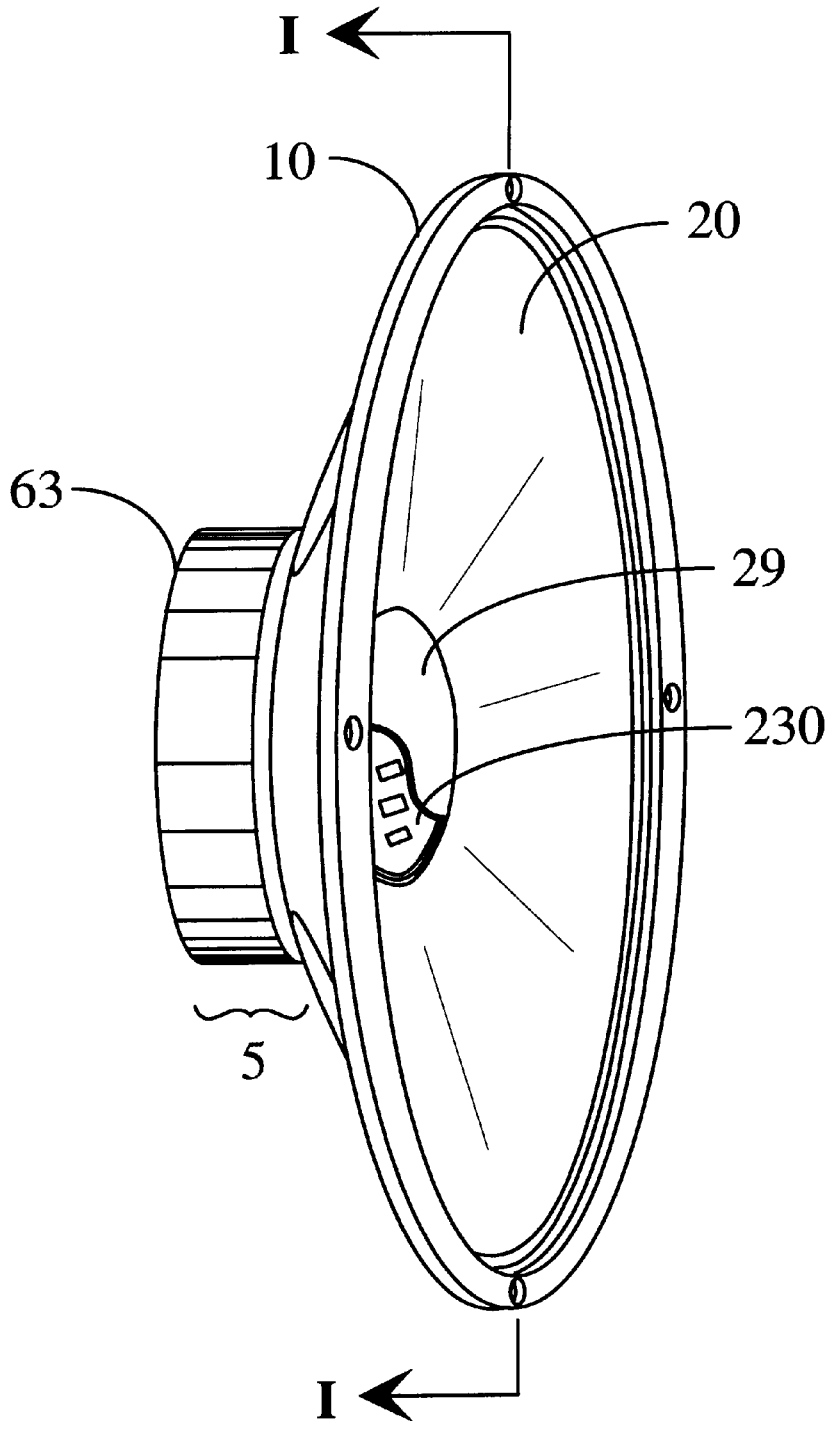
FIG. 8 is an overall isometric view of a third embodiment of the present invention.
Figure 9:
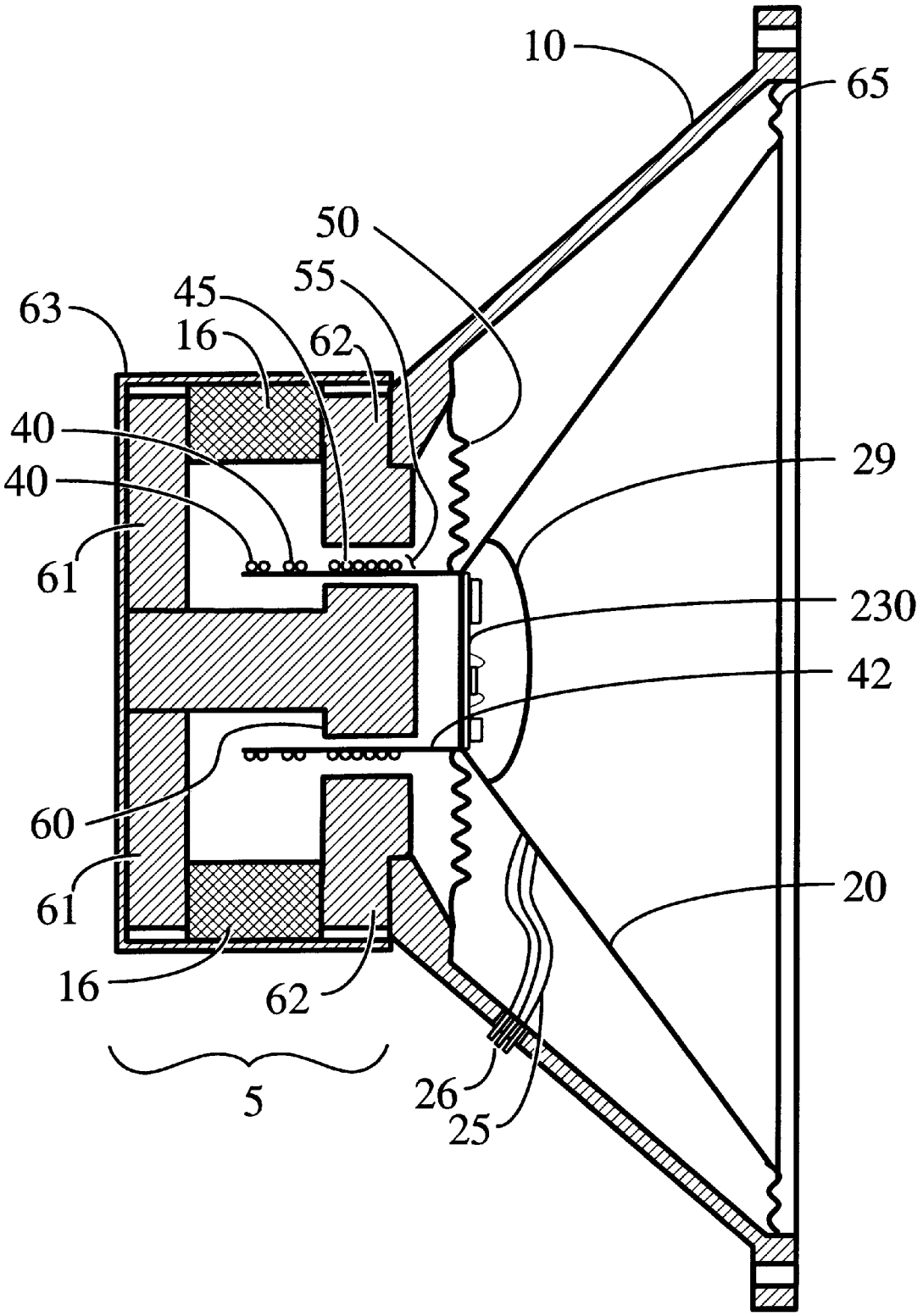
FIG. 9 is a cross sectional view of the third embodiment of the present invention through section II.

A second sample embodiment of the present invention is shown in FIG. 5, FIG. 6, and FIG. 7. FIG. 5 and FIG. 6 show an amplified loudspeaker similar to that of the first sample embodiment of the present invention except that amplifier circuit, 130, is now housed inside of magnetic assembly, 105. Magnetic assembly, 105, consists of annularly shaped axially oriented magnet, 16, center pole piece, 60, back plate, 161, front plate, 62, and magnetic shielding, 163. Amplifier circuit, 130, which is schematically identical to amplifier circuit, 30, and shown in FIG. 3., is now mounted on an annularly shaped substrate, 134, as shown in FIG. 7. This annularly shaped substrate, 134, is attached to back plate, 161, of magnetic assembly, 105. During operation of the amplified loudspeaker, the heat generated by amplifier circuit, 130, is thermally conducted into back plate, 161, and then the remainder of magnetic assembly, 105. The large external surface area of the magnetic assembly, 105, and loudspeaker housing, 10, form an efficient heat sink at insignificant increase in manufacturing cost.

Amplifier circuit, 130, is electrically connected to voice coil, 45, through tinsel wires, 125, which also reside within magnetic assembly, 105. Further mounted in magnetic assembly, 105, is electrical connector, 126, through which electronic power and an appropriate audio signal may be provided.

A third and more preferred sample embodiment of the present invention is shown in FIG. 8, FIG. 9, FIG. 10, and FIG. 11. In this third embodiment, the simple traditional amplifier circuit, 30, of the first sample embodiment is replaced with amplifier circuit, 230, utilizing an advanced class D amplifier to drive voice coil, 45, with higher efficiency.

Figure 10:
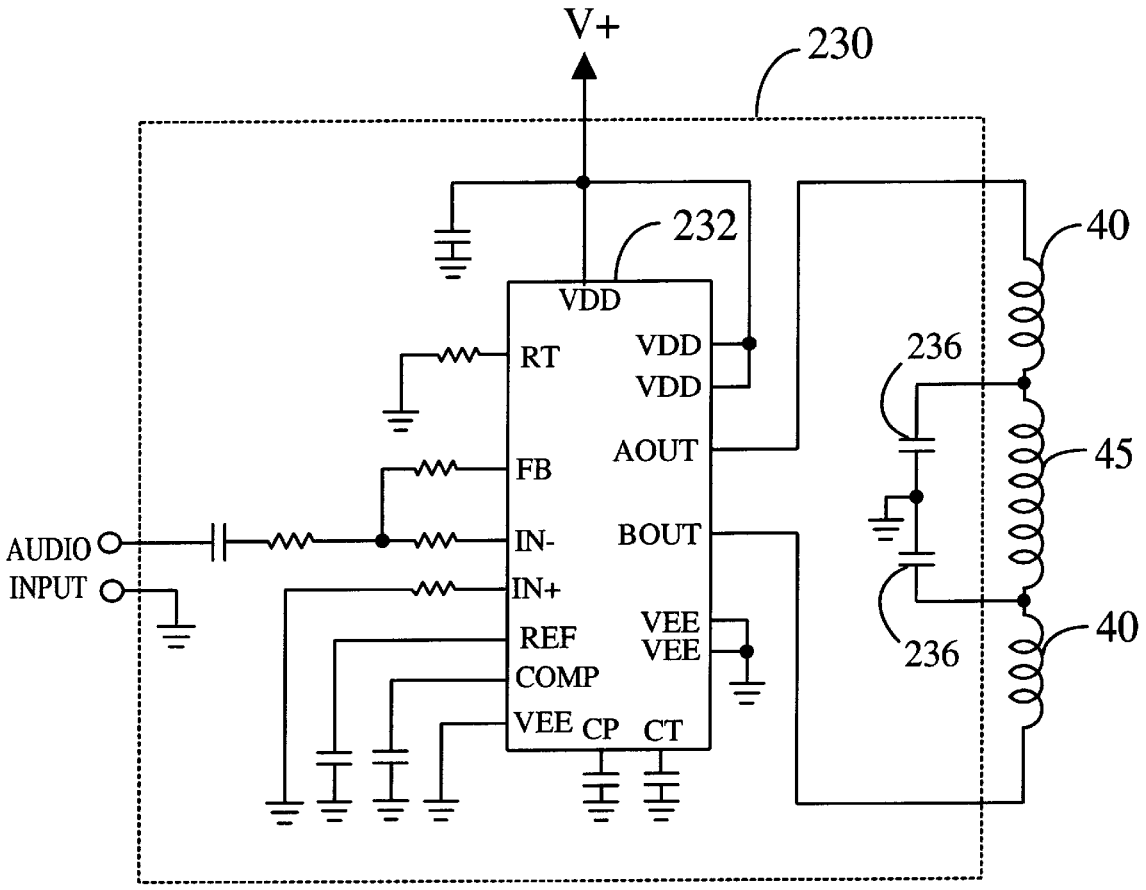
FIG. 10 is a schematic representation of the electronic circuitry according to the third and fourth embodiments of the present invention.

In FIG. 10, a schematic representation of a typical class D amplifier circuit is shown. Of notable interest is the fact that class D based amplifier circuit, 230, attached to substrate, 234, shown in FIG. 11, requires inductive components, 40. A special cost advantage of the present invention is the ability to create inductive components, 40, by winding them onto former, 42, at the same time that voice coil, 45, is also wound onto former, 42. Inductive components, 40, are also generally of the power inductor type and can be relatively expensive and bulky. Mounting them on former, 42, along with voice coil, 45, eliminates the cost of these inductive components, 40, since they can preferably be manufactured jointly with the voice coil, 45.

Traditionally, off-the-shelf inductors, air wound inductors, laminated printed circuit board inductors, solid core inductors, etc., are used to filter and integrate out the square wave output associated with class D amplifiers. Since the output of class D amplifiers have a very fast rise time, they can potentially generate severe electromagnetic interference (EMI). This EMI is primarily caused by the wire length between the class D amplifier's outputs and the inductive components, 40. Additionally, if the inductive component, 40, is an open wound coil as opposed to a closed wound coil, such as a torroid, it also can be a significant contributor to radiated EMI. It is therefore extremely desirable to both shield the inductive components and their connections to the class D amplifier outputs and to minimize the wire lengths of these connections.

It is a specific feature of the present invention to provide a cost effective means for shielding inductive components, 40, and their associated electronic connections. This is accomplished by placing these EMI generating components inside the cavity inherently created by magnetic assembly, 5.

In this third embodiment of the present invention, inductive components, 40, are mounted on the far end of former, 42, which is always positioned inside the inherent magnetic cavity created by magnetic assembly, 5. Since inductors, 40, are not in the magnetic gap, 55, they act as true inductive components unlike voice coil, 45, which resides in magnetic gap, 55, and act more like a resistive component.

Figure 11:
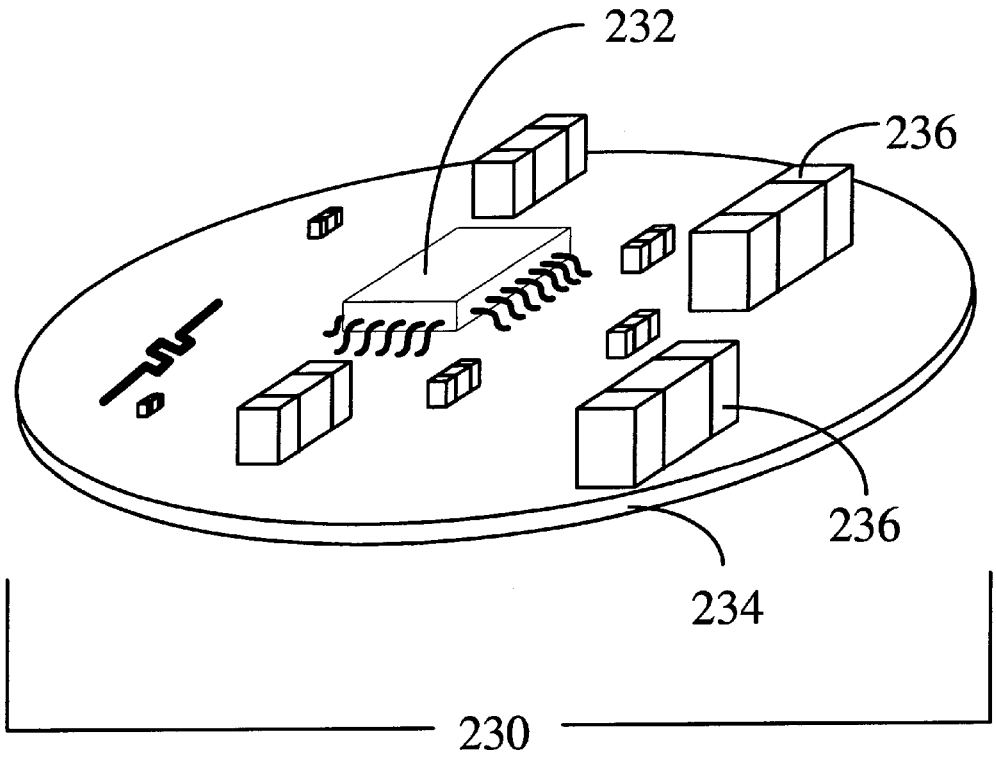
FIG. 11 is an isometric view of the amplifier circuit according to the third embodiment of the present invention.

The required capacitive components, 236, are also mounted on substrate, 234, as observed in FIG. 10 and FIG. 11. These capacitive components, 236, could also have been mounted on former, 42.

The connections from amplifier circuit, 230, to inductive components, 40, and voice coil, 45, can be achieved using solder, solder reflow, ultrasonic bonding techniques, etc.. As in the first embodiment, power and appropriate audio signal connections are made using standard tinsel wire, 25, running from amplifier circuit, 230, to connector, 26.

Figure 12:
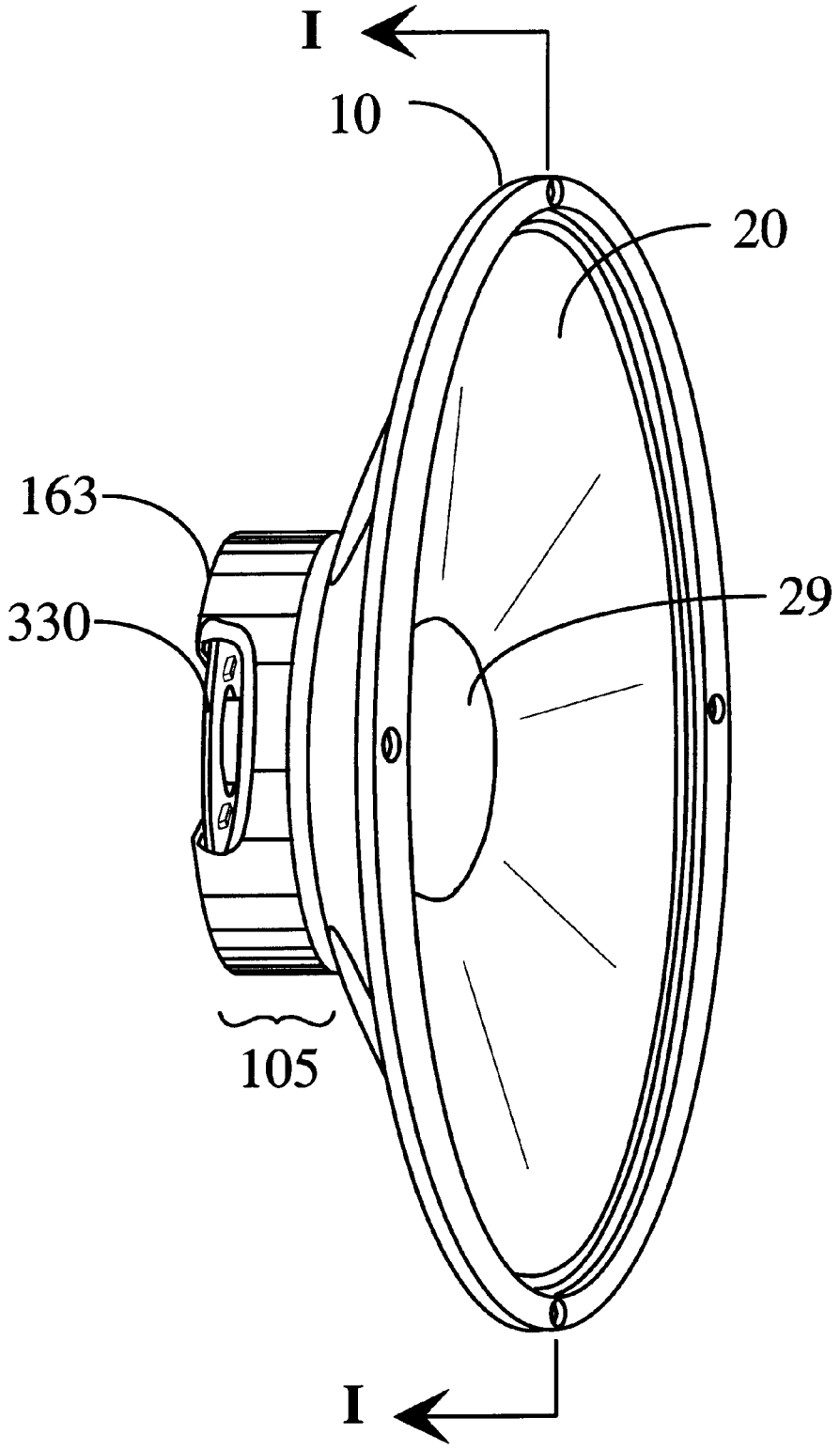
FIG. 12 is an overall isometric view of a fourth embodiment of the present invention.
Figure 13:
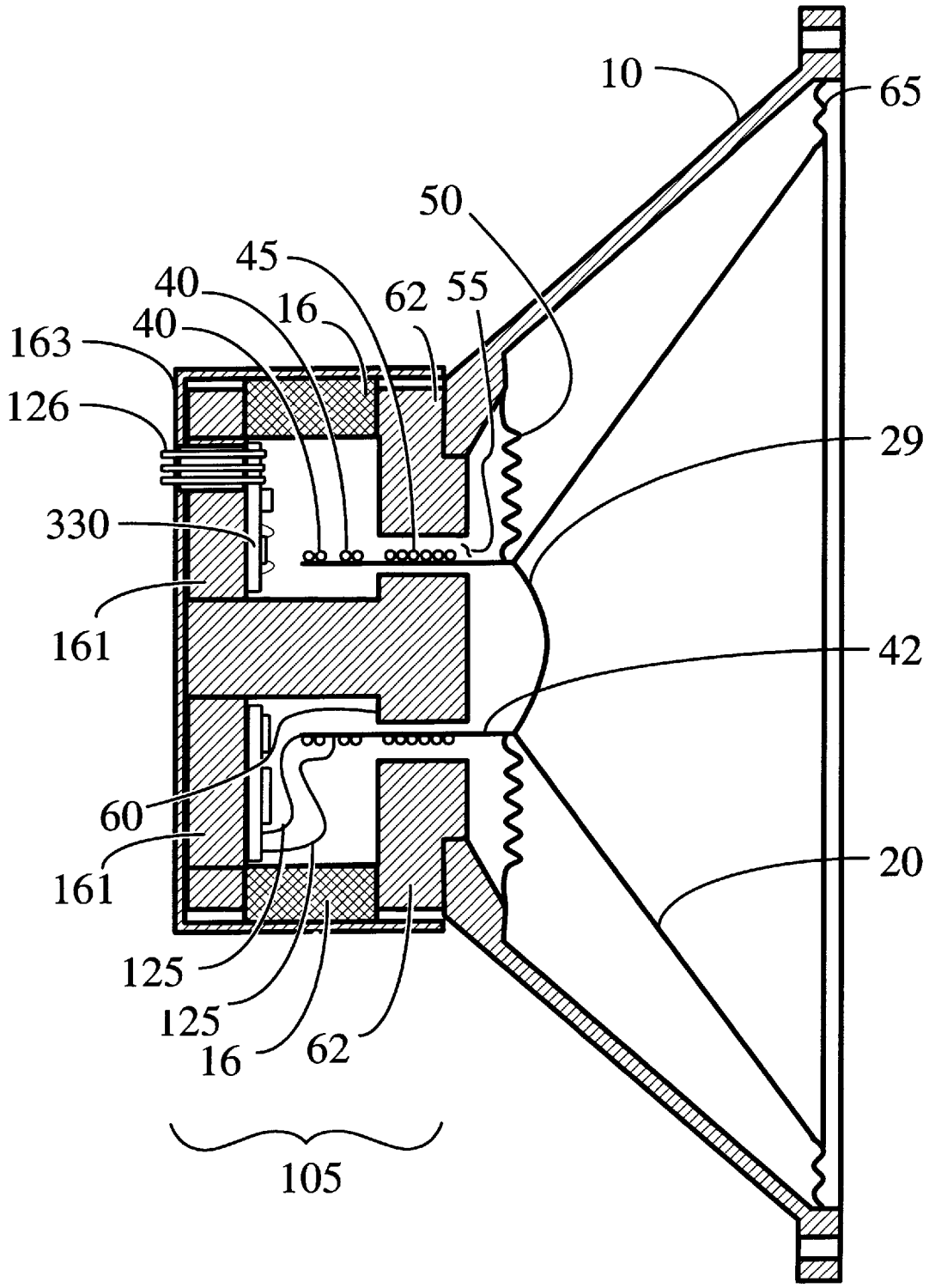
FIG. 13 is a cross sectional view of the fourth embodiment of the present invention through section II.
Figure 14:
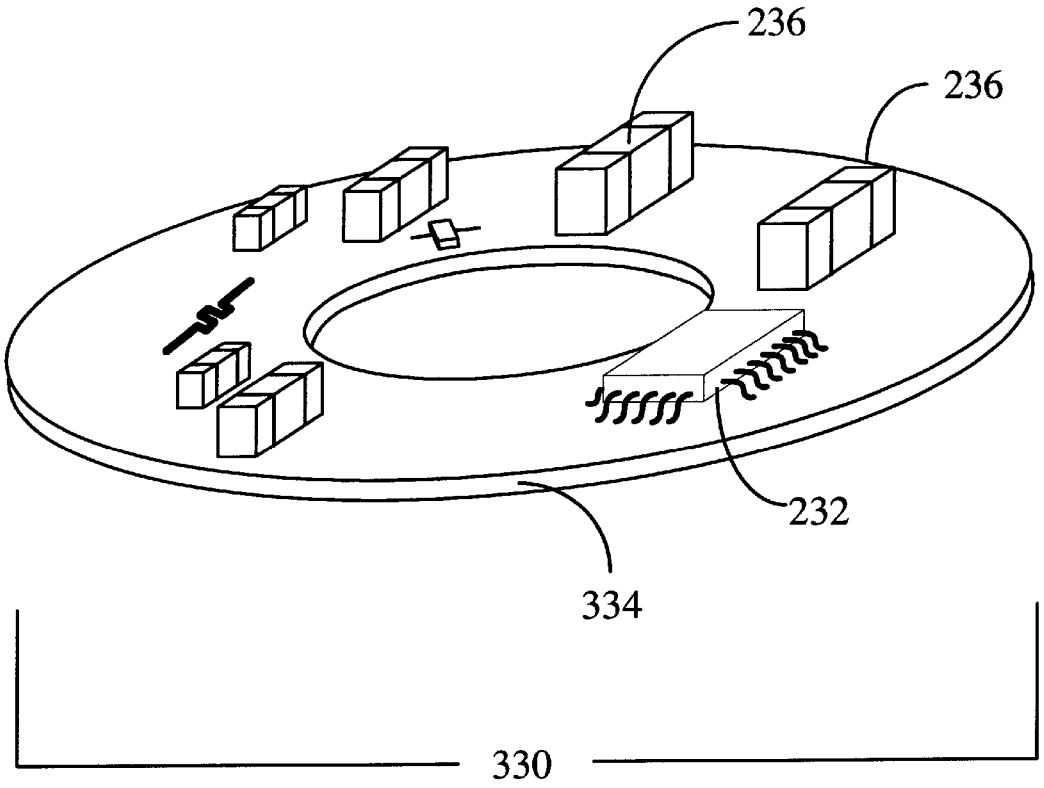
FIG. 14 is an isometric view of the amplifier circuit according to the fourth embodiment of the present invention.

A fourth preferred sample embodiment of the present invention is shown in FIG. 12, FIG. 13, and FIG. 14 where amplifier circuit, 330, which is schematically identical to amplifier circuit, 230, and shown in FIG. 10, is housed inside the loudspeaker's magnetic assembly, 105. To achieve this, amplifier circuit, 330, is now mounted on an annularly shaped substrate, 334, as shown in FIG. 14. This annularly shaped substrate, 334, is placed against the inside back plate, 161, of magnetic assembly, 105. Here, amplifier circuit, 330, is electrically coupled through tinsel wires, 125, and inductive components, 40, to voice coil, 45, which also resides within magnetic assembly, 105. Further mounted in magnetic assembly, 105, is electrical connector, 126, through which electronic power and an appropriate audio signal is provided.

In this fourth sample embodiment, the inductive components, 40, have also been mounted on former, 42, next to voice coil, 45, with the remainder of the circuitry mounted on substrate, 334. Additionally, this type of embodiment, where amplifier circuit, 330, is maintained in a stationary position, an embodiment of the present invention is able to achieve higher frequency performance. By detaching the amplifier circuit and associated components from the former, 42, a lower mass can be achieved for voice coil, 45, and former, 42, assemblies. This lowered mass results in the above mentioned higher frequency performance. Ideally, the fourth embodiment of the present invention is specifically suited for tweeter applications whereas the third embodiment is specifically suited for base and midrange applications. Further, inductive components, 40, could also be mounted on substrate, 334, if further enhancement of tweeter performance is desired. However, the cost of inductive components, 40, would now be greater.

Figure 17:
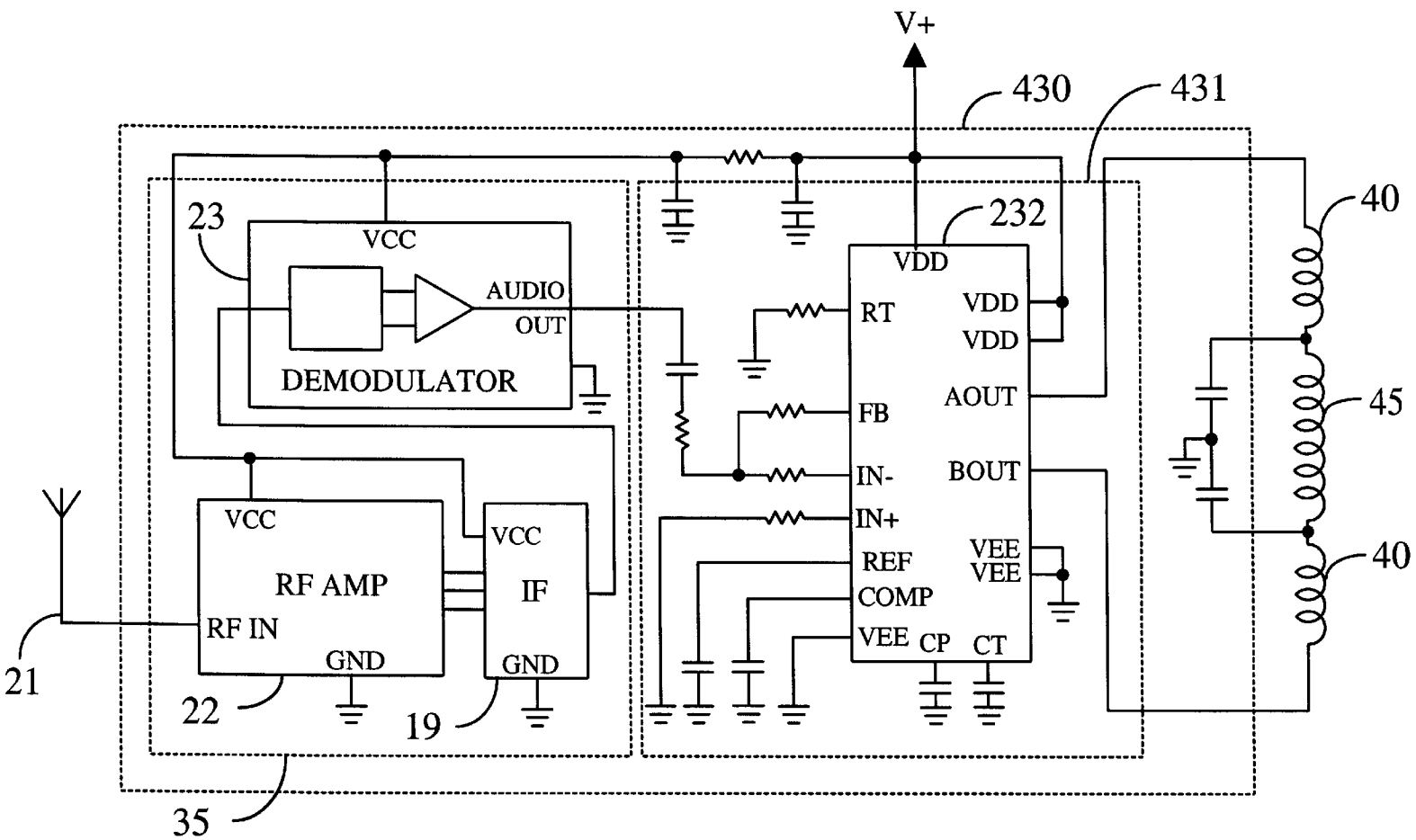
FIG. 17 is a schematic representation of the electronic circuitry according to the fifth embodiment of the present invention.
Figure 18:
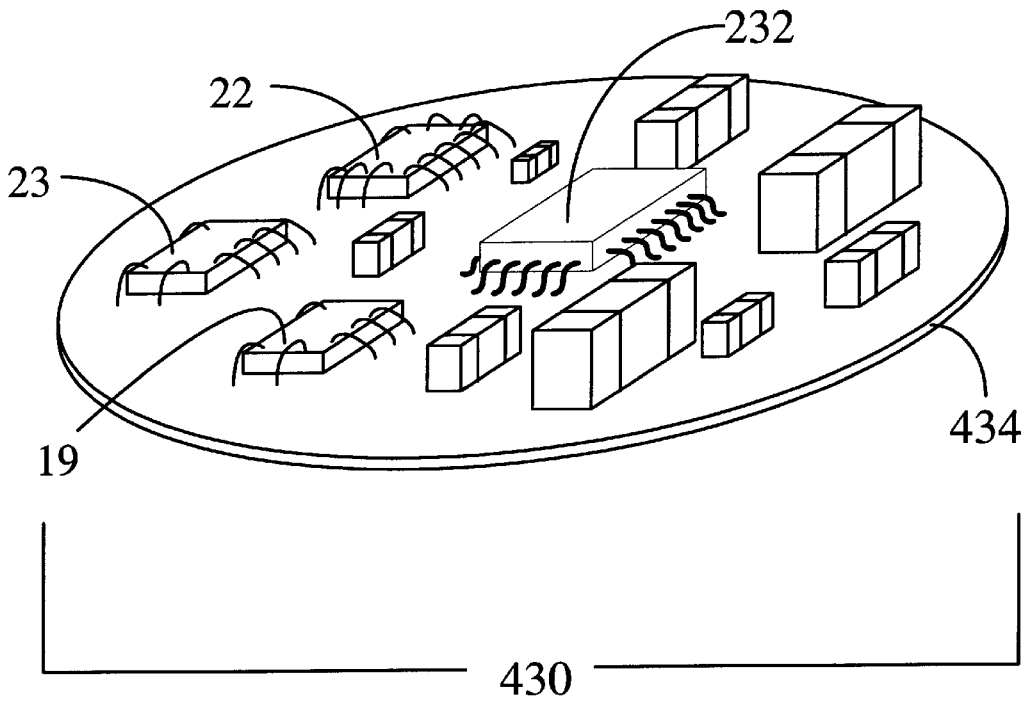
FIG. 18 is an isometric view of the radio frequency receiver and amplifier circuit according to the fifth embodiment of the present invention.

A fifth and even more preferred sample embodiment of the present invention incorporating a radio-frequency receiver is shown in FIG. 15, FIG. 16, FIG. 17, and FIG. 18. Radio-frequency receiver, 35, is connected to amplifier circuit, 431, and collectively identified as receiver-amplifier circuit, 430, mounted on former, 42. In FIG. 17, a radio-frequency receiver, 35, has been connected to amplifier circuit, 431, to provide a means for remotely applying an audio program source to the amplified loudspeaker. This would provide the ability to remotely control loudspeaker volume and/or audio program source. Radio-frequency receiver, 35, and amplifier circuit, 431, make-up receiver-amplifier, 430, both mounted on former, 42, using substrate, 434.

Although radio-frequency receiver, 35, is shown as a traditional implementation utilizing a radio frequency(RF) amplifier, 22, an intermediate frequency(IF) amplifier, 19, and demodulator, 23, it will soon be possible to provide these functions in a single integrated circuit component. This and other circuit variations will soon make a group of even more preferred embodiments of this present invention possible. Single integrated circuit receivers are already a reality in low frequency amplitude modulation(AM) applications, but this will shortly be possible at higher frequencies. The cellular phone industry is in the forefront of developing these technologies today.

Figure 15:
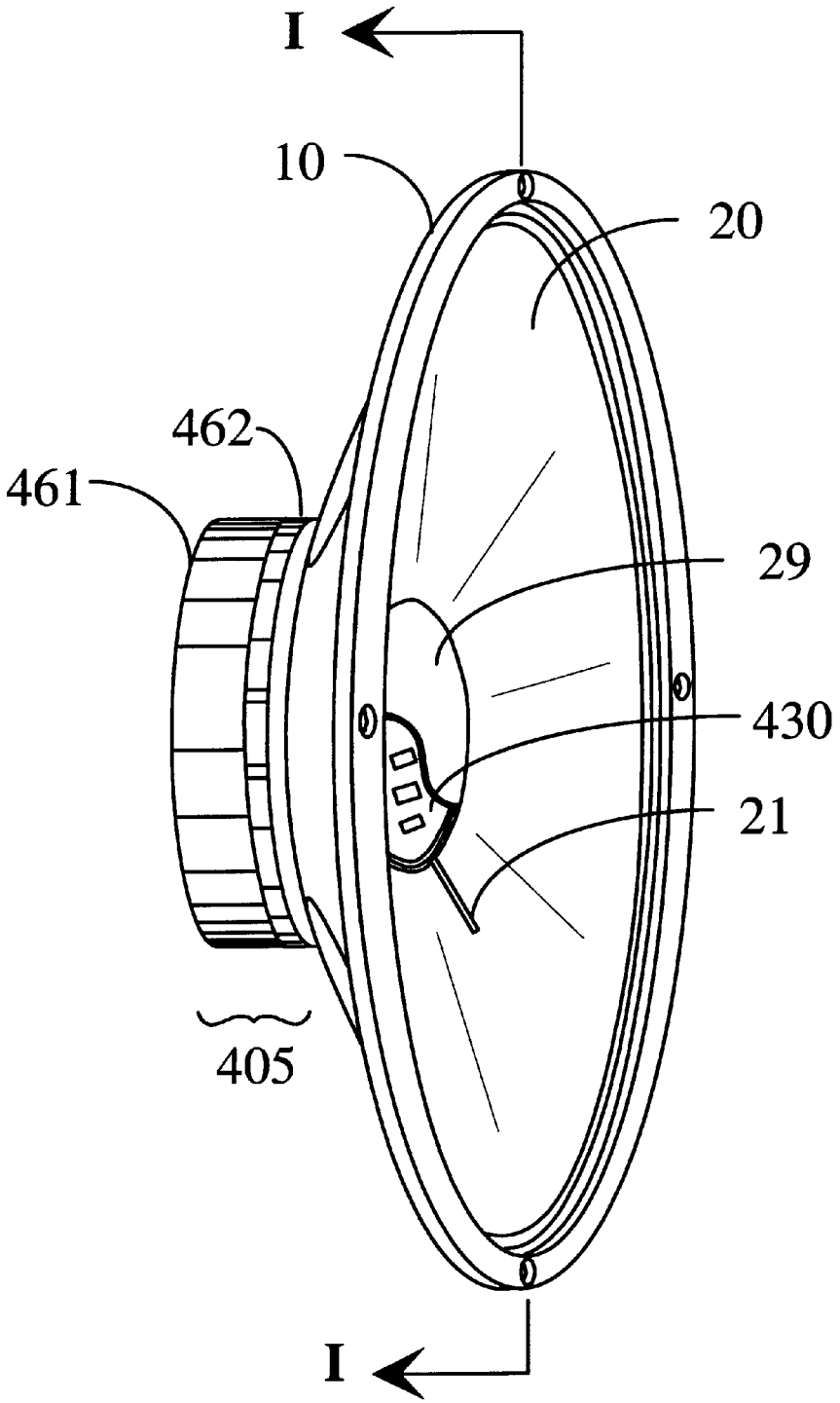
FIG. 15 is an overall isometric view of a fifth embodiment of the present invention.
Figure 16:
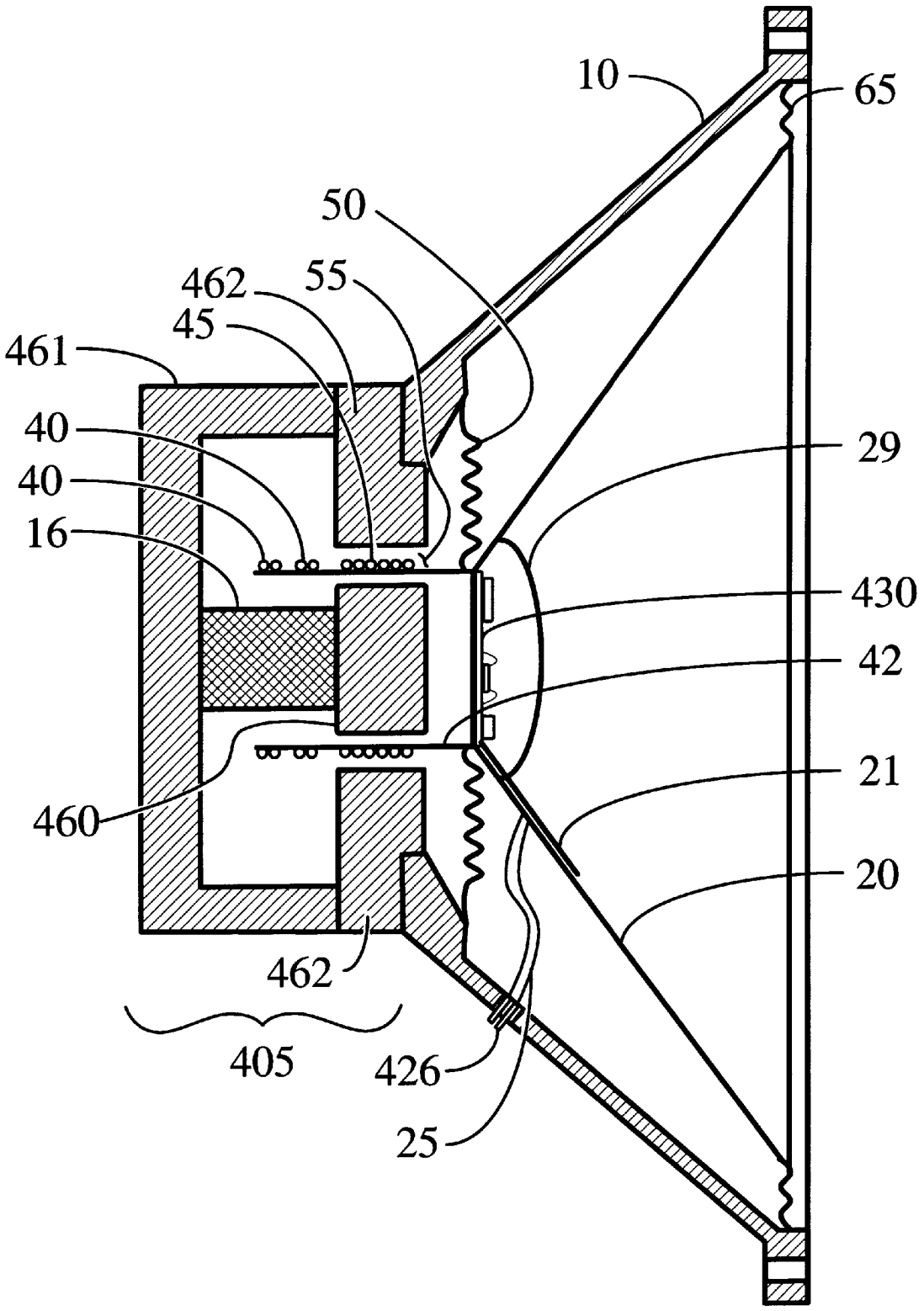
FIG. 16 is a cross sectional view of the fifth embodiment of the present invention through section II.

The signal input to radio-frequency amplifier, 35, is provided by antenna, 21, attached to loudspeaker cone, 20, as shown in FIG. 15. This antenna, 21, can be made as a simple metal foil of appropriate length bonded to the surface of speaker cone, 20.

Figure 19:
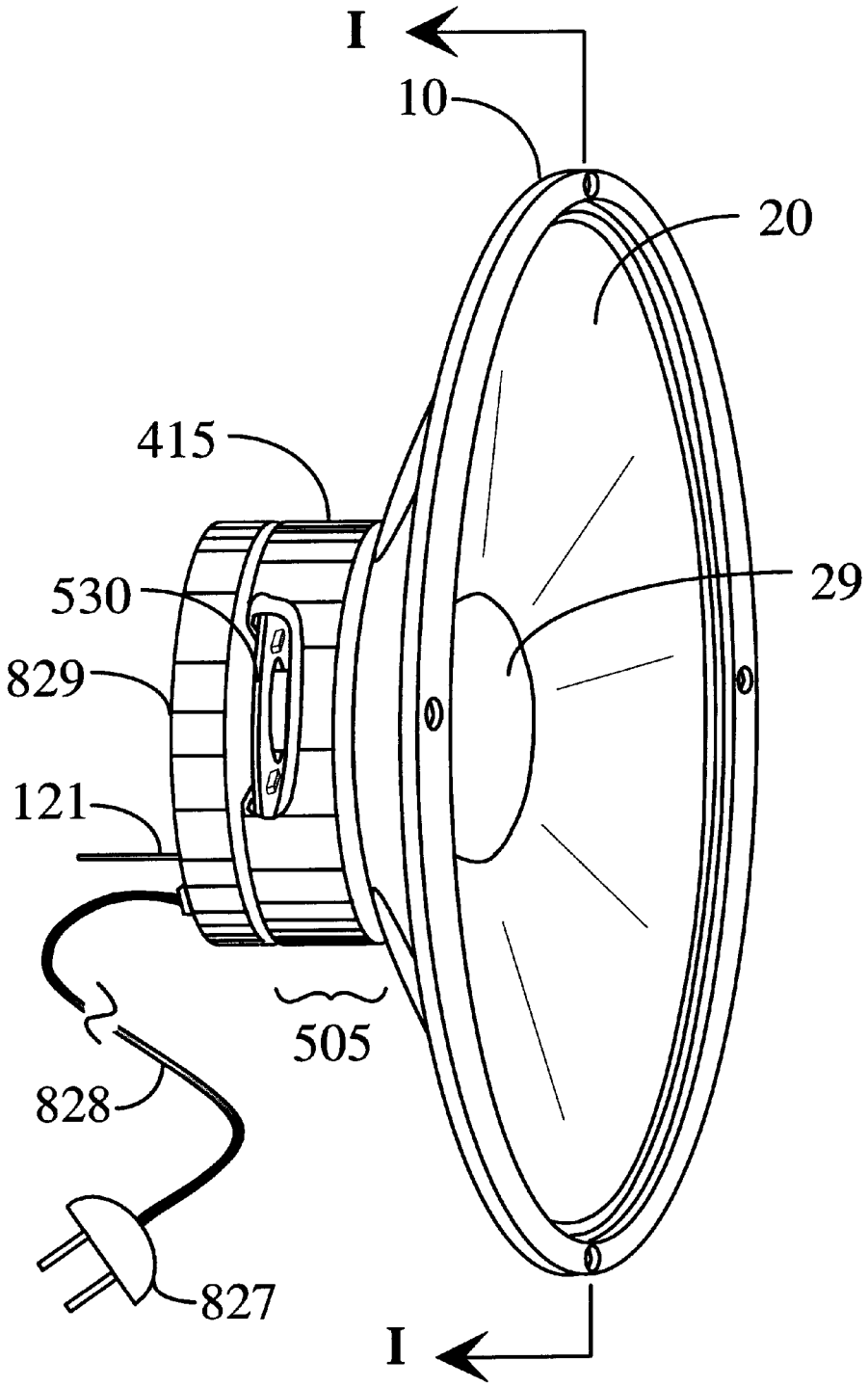
FIG. 19 is an overall isometric view of a sixth embodiment of the present invention.
Figure 20:
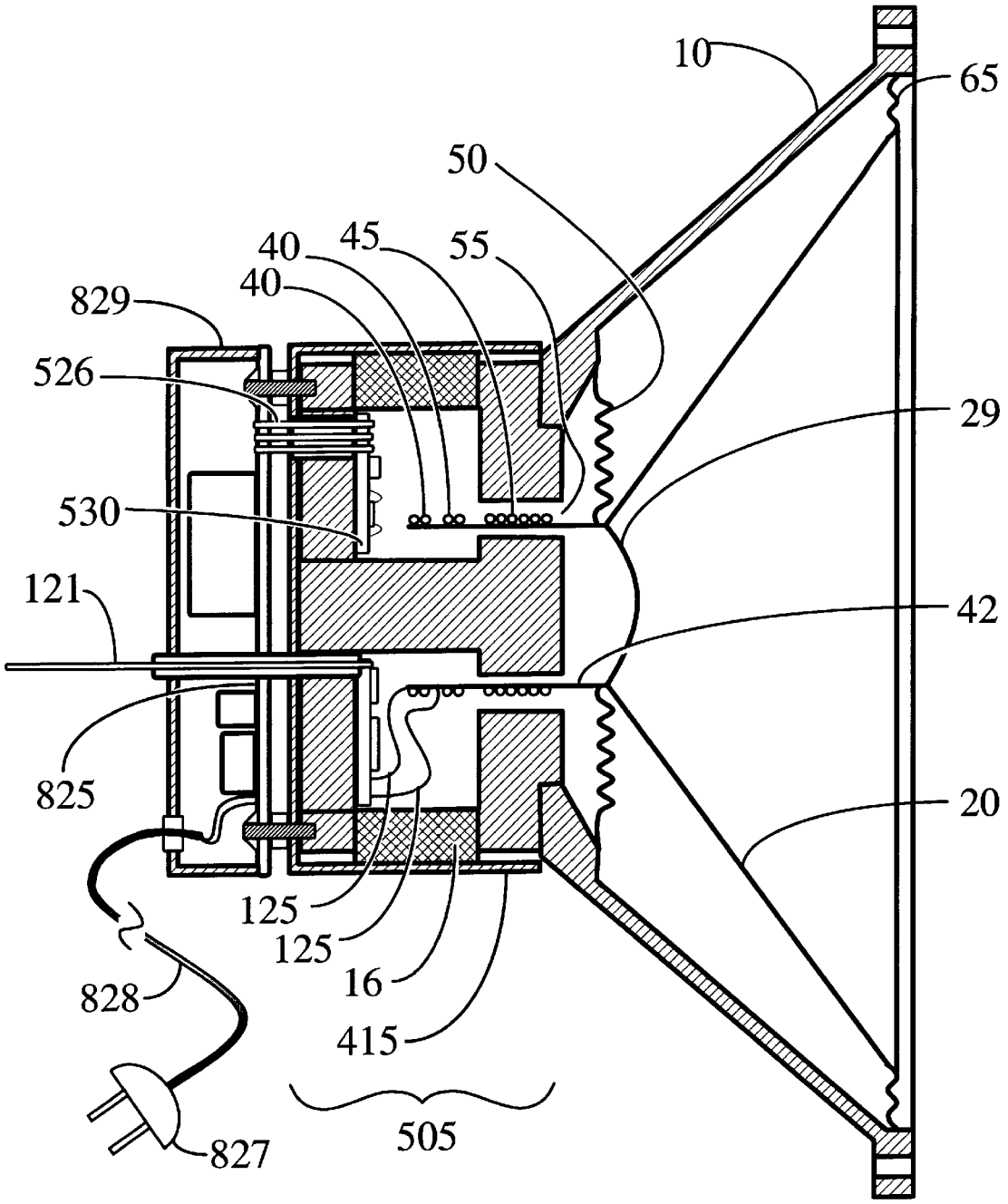
FIG. 20 is a cross sectional view of the sixth embodiment of the present invention through section II.
Figure 21:
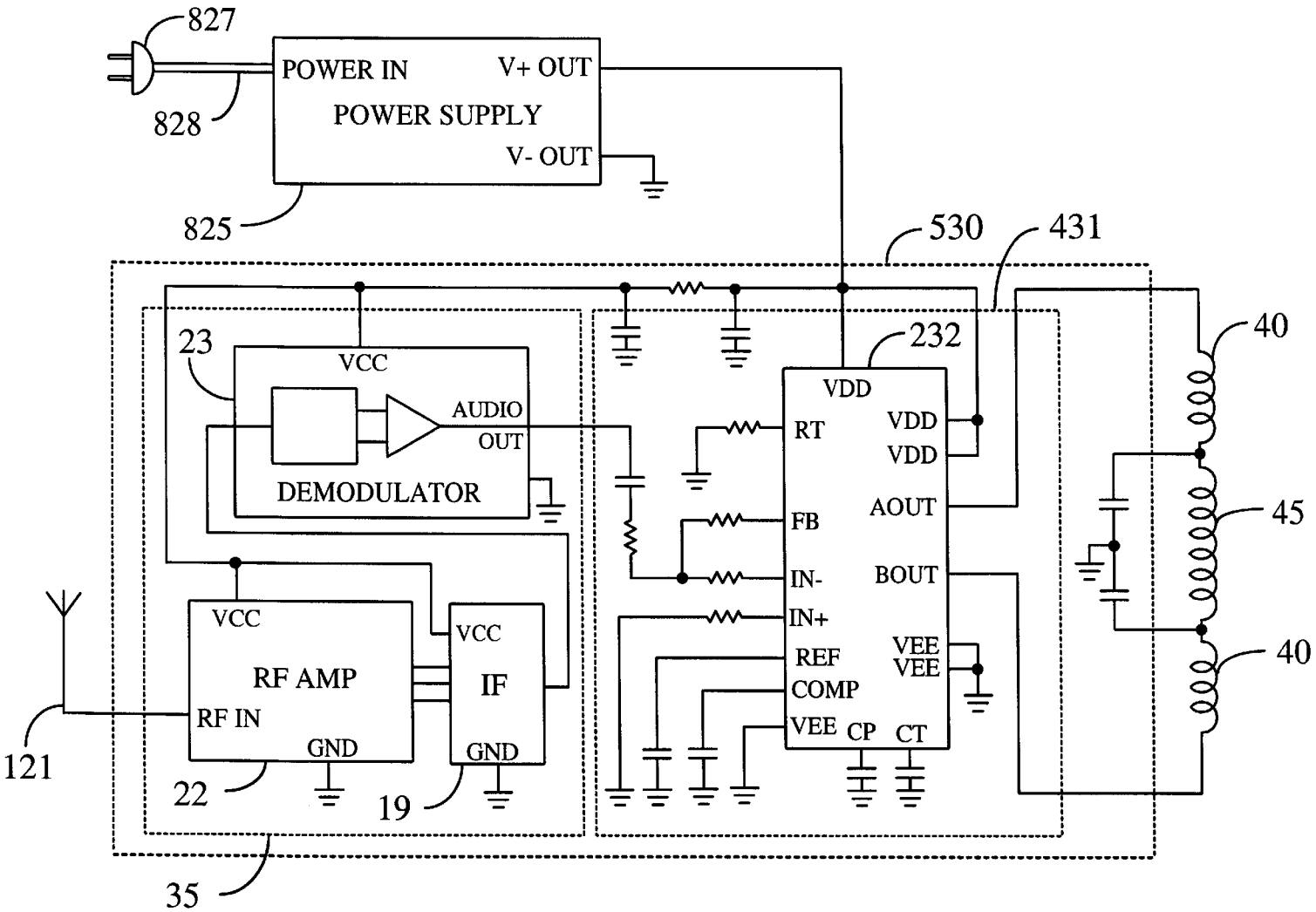
FIG. 21 is a schematic representation of the electronic circuitry according to the sixth embodiment of the present invention.
Figure 22:
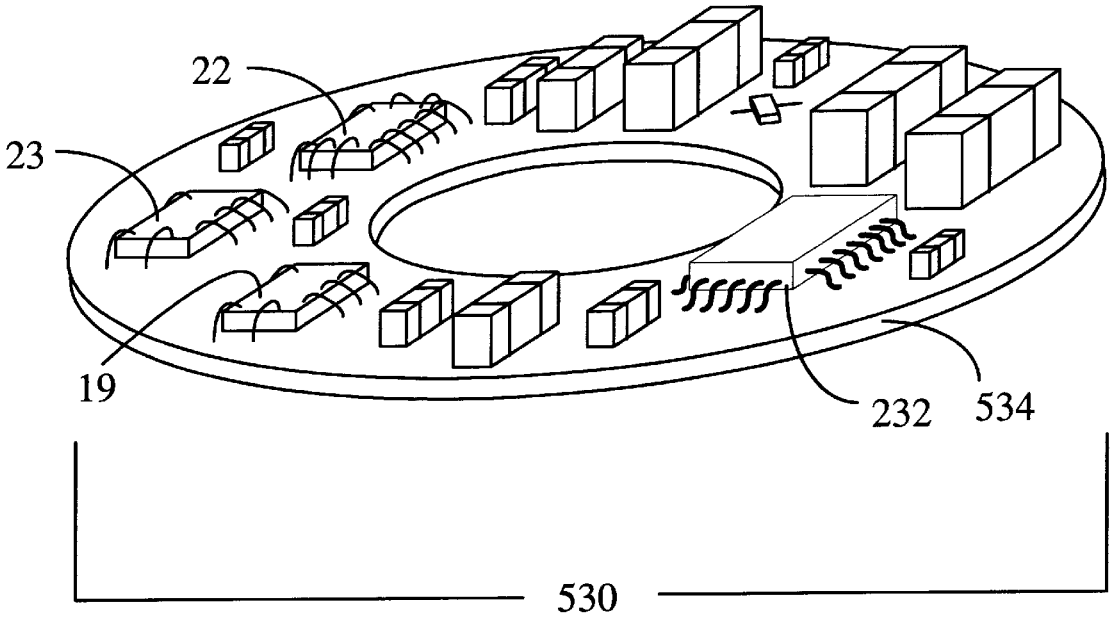
FIG. 22 is an isometric view of the radio frequency receiver and amplifier circuit according to the sixth embodiment of the present invention.

A sixth sample embodiment of the present invention is shown in FIG. 19, FIG. 20, FIG. 21 and FIG. 22. FIG. 19 and FIG. 20 show an amplified loudspeaker similar to that of the fifth sample embodiment except that radio-frequency receiver, 35, and amplifier circuit, 431, are now housed inside of the loudspeaker's magnetic assembly. The receiver amplifier circuit, 530, which is schematically identical to the receiver amplifier circuit, 430, shown in FIG. 17. of the fifth sample embodiment, is now mounted inside rear wall of magnetic assembly, 505, using annularly shaped substrate, 534, as shown in FIG. 22. The receiver amplifier circuit, 530, is electrically coupled through tinsel wires, 125, and inductive components, 40, to voice coil, 45, which also resides within magnetic assembly, 505. Further mounted in magnetic assembly, 505, is electronic connector, 526, through which electronic power is provided. Similarly, antenna, 121, provides a connection for receiving a radio frequency input signal.

Also shown in this embodiment of the present invention is a piggy-back power supply, 825, with power cord, 828, and power plug, 827, and cover, 829. The power supply, 825, is mounted on the back of magnetic assembly, 505, with cover, 829, attached. FIG. 21 is a schematic representation showing power supply, 825, powering radio-frequency receiver, 35, and amplifier circuit, 431. This configuration provides a plug-in-the-wall-device marketable to the end consumer requiring no traditional speaker wire or audio signal connection.

Figure 23:
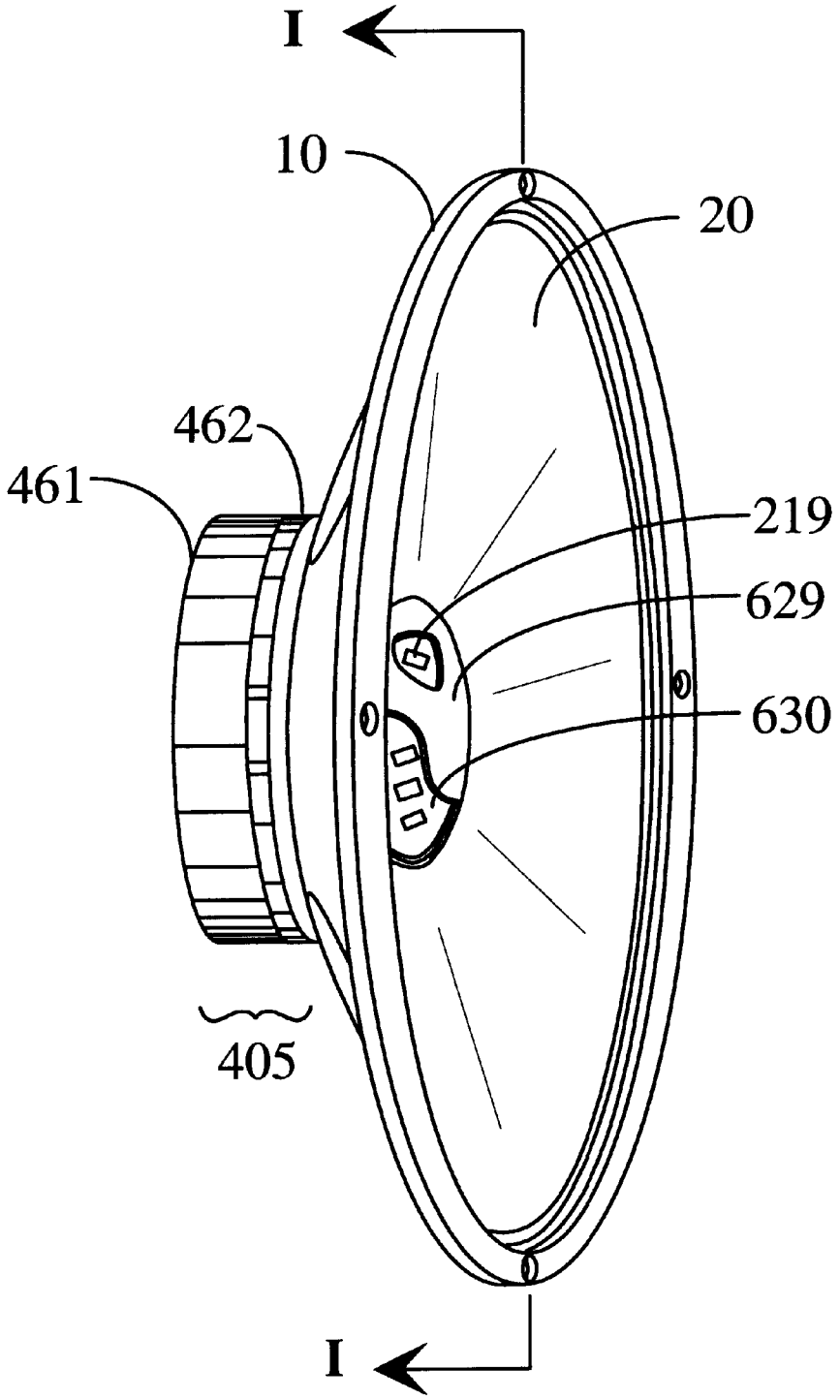
FIG. 23 is an overall isometric view of a seventh embodiment of the present invention.
Figure 24:
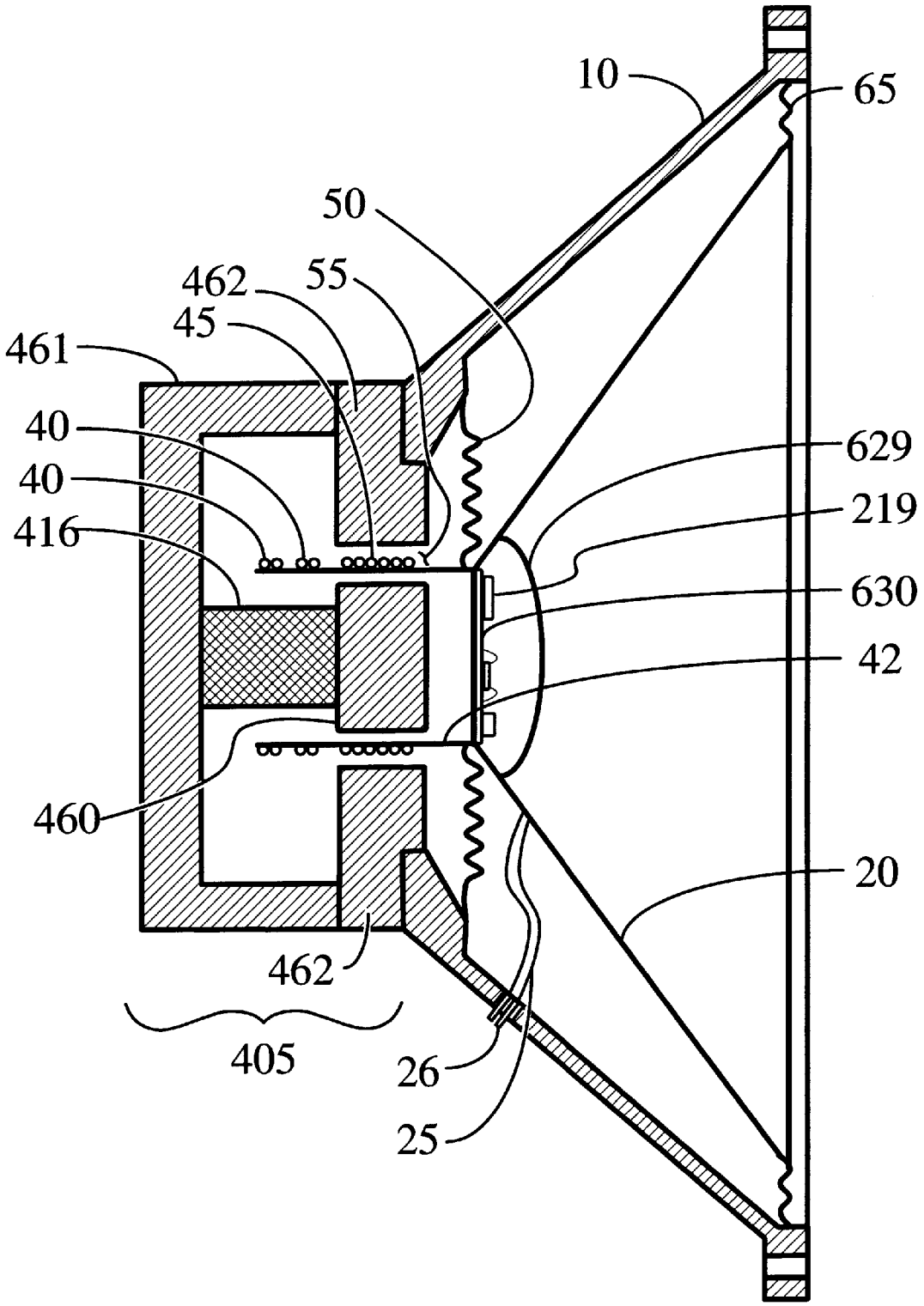
FIG. 24 is a cross sectional view of the seventh embodiment of the present invention through section II.
Figure 25:
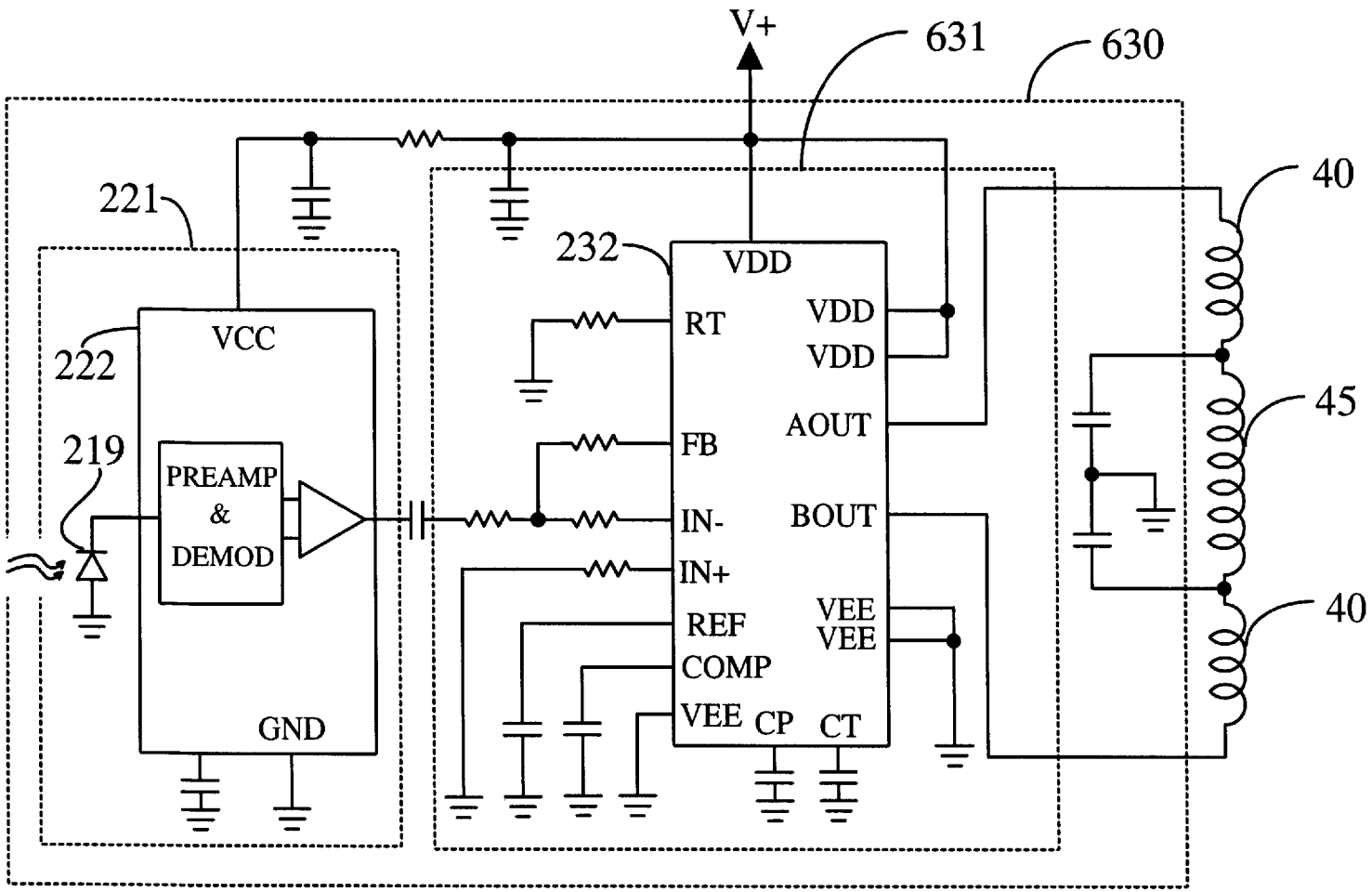
FIG. 25 is schematic representation of the electronic circuitry according to the seventh embodiment of the present invention.
Figure 26:
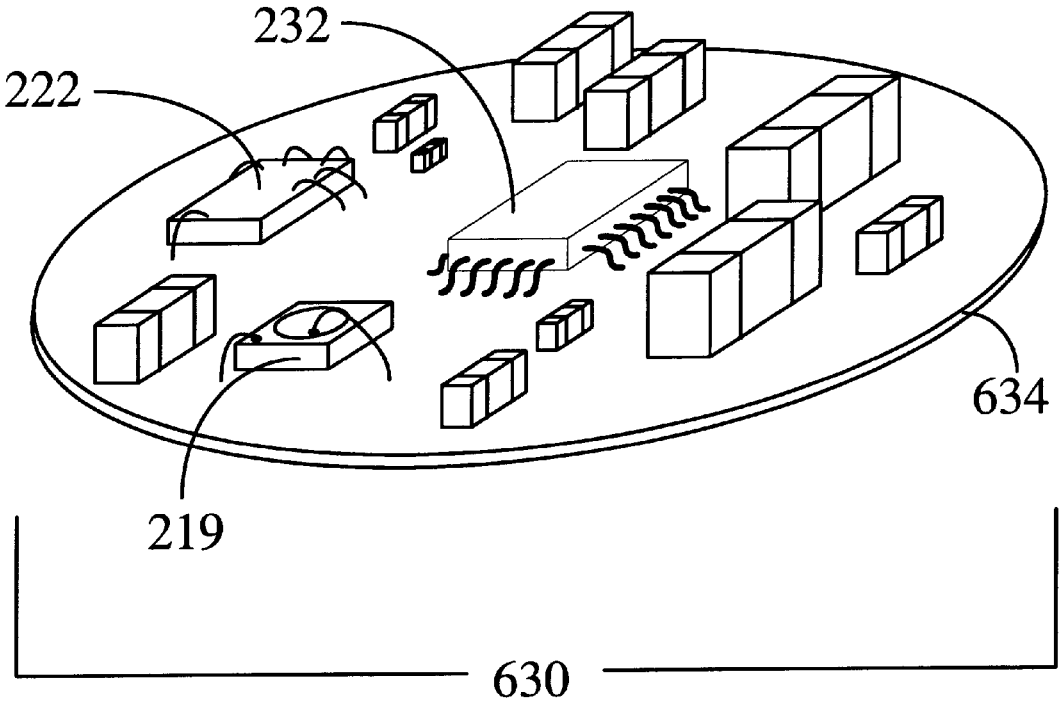
FIG. 26 is an isometric view of the optical interface and amplifier circuit according to the seventh embodiment of the present invention.

A seventh preferred sample embodiment of the present invention is shown in FIG. 23, FIG. 24, FIG. 25, and FIG. 26 where an optical interface, 221, is now incorporated. The optical interface, 221, is shown as alternate to the radio-frequency receiver configurations of previous embodiments. In FIG. 25, an optical interface, 221, has been connected to amplifier circuit, 631, to provide a means for remotely applying an audio program source to the amplified loudspeaker. This would provide the ability to remotely control loudspeaker volume and/or audio program source. Optical interface, 221, and amplifier circuit, 631, create receiver-amplifier, 630, mounted on former, 42, using substrate, 634. Dust cover, 629, shown in FIG. 23 and FIG. 24 is made up of an optically transparent material to allow optical energy to reach optical sensor, 219, of optical interface, 221.

Figure 27:
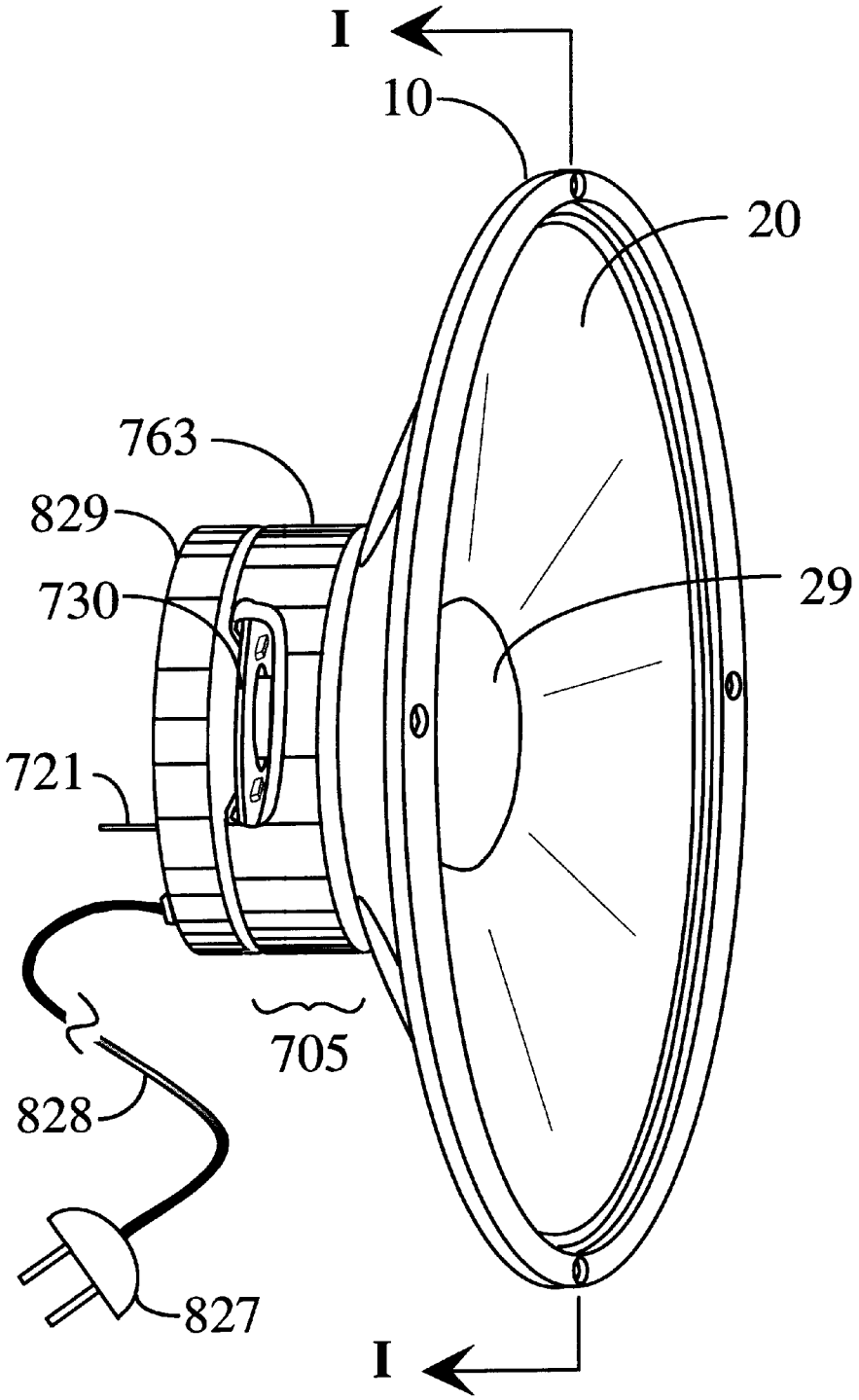
FIG. 27 is an overall isometric view of a eighth embodiment of the present invention.
Figure 28:
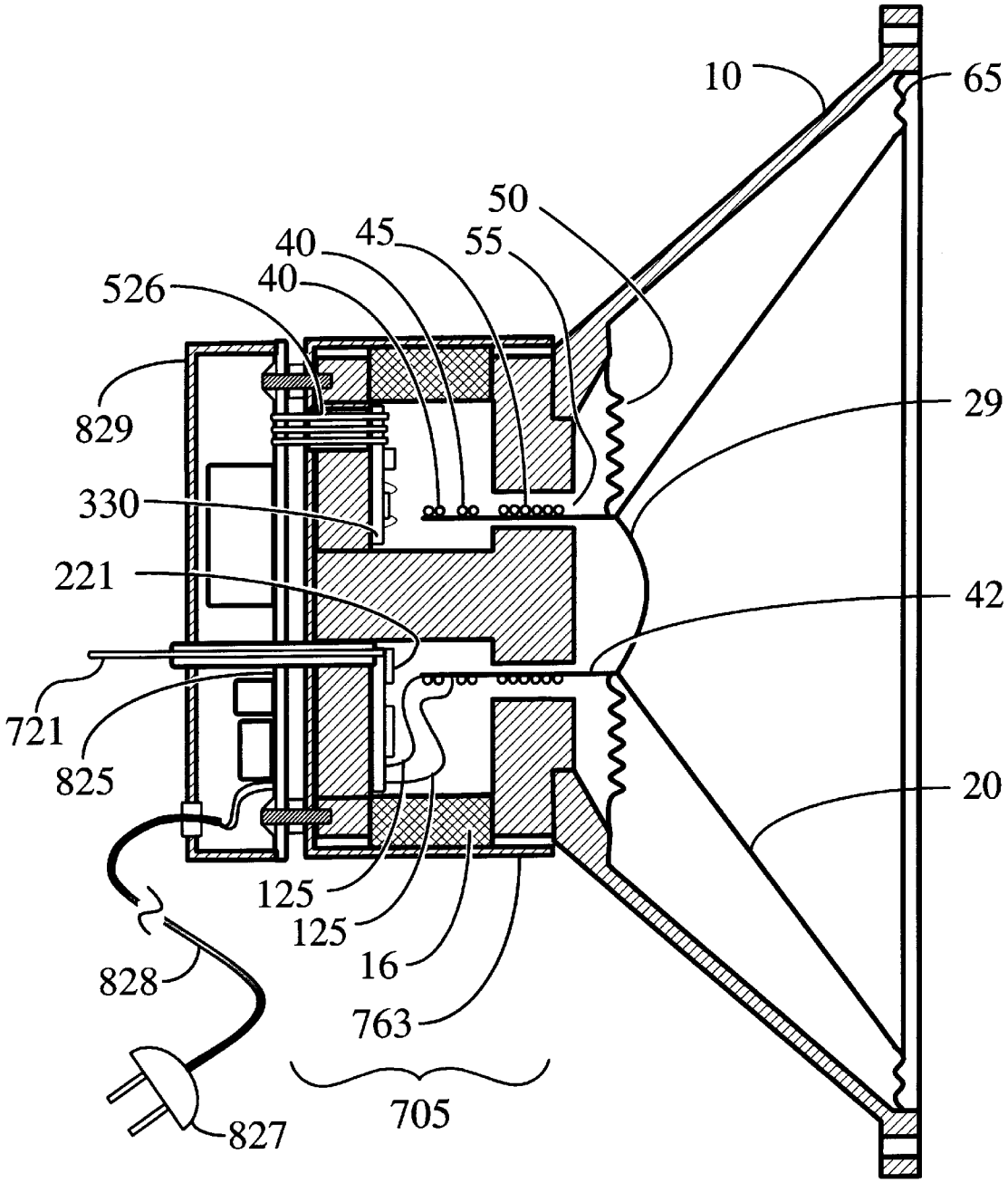
FIG. 28 is a cross sectional view of the eighth embodiment of the present invention through section II.

An eighth sample embodiment of the present invention is shown in FIG. 27, FIG. 28, FIG. 29, and FIG. 30. FIG. 27 and FIG. 28 show an amplified loudspeaker where optical interface, 221, and amplifier circuit, 731, are now mounted on the inside rear wall of the loudspeaker's magnetic assembly, 705. The receiver amplifier circuit, 731, is electrically connected to voice coil, 45, through tinsel wires, 125, which also reside within magnetic assembly, 705. Further mounted in magnetic assembly, 705, is electrical connector, 526, through which electronic power is connected, and optical connection, 721, through which an input signal is provided. This optical connection is shown as an optical fiber, but it could also be simply a transparent window through magnetic assembly, 705, power supply, 825, and cover, 829, to allow optical energy to reach optical sensor, 291, in optical interface, 221.

Figure 29:
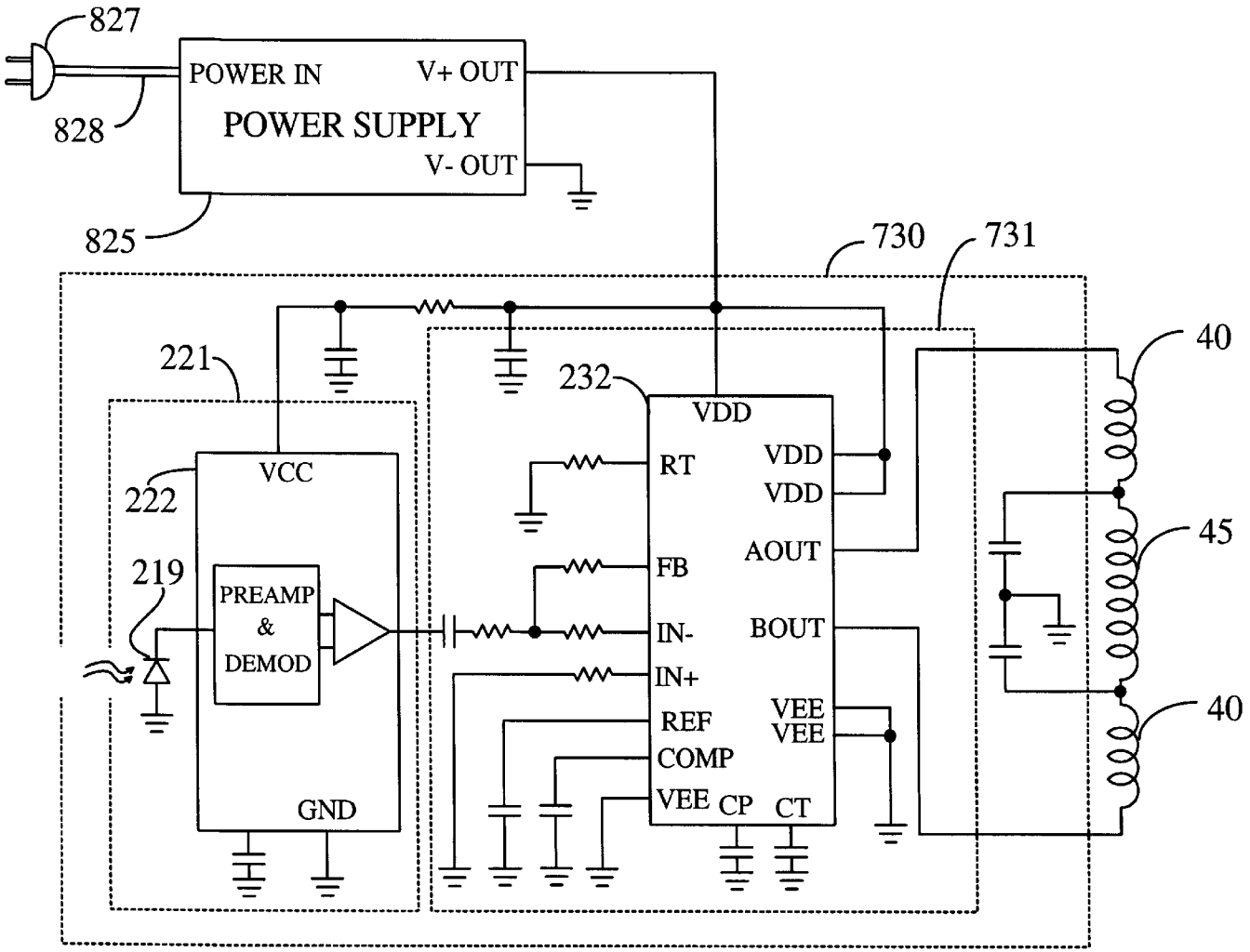
FIG. 29 is a schematic representation of the electronic circuitry according to the eighth embodiment of the present invention.
Figure 30:
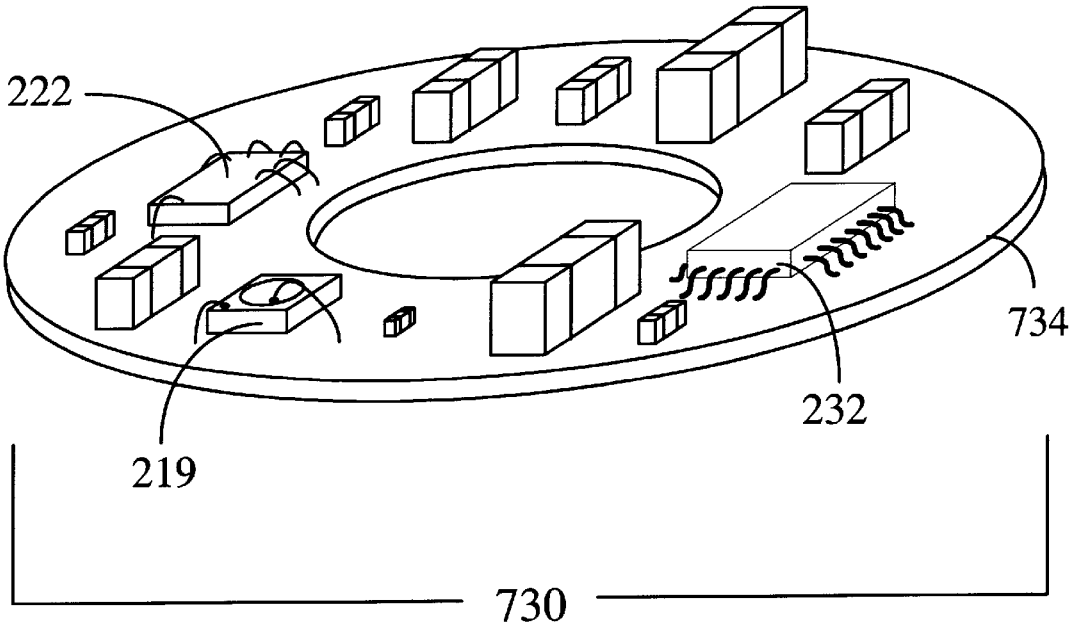
FIG. 30 is an isometric view of the optical interface and amplifier circuit according to the eighth embodiment of the present invention.
Figure 31:
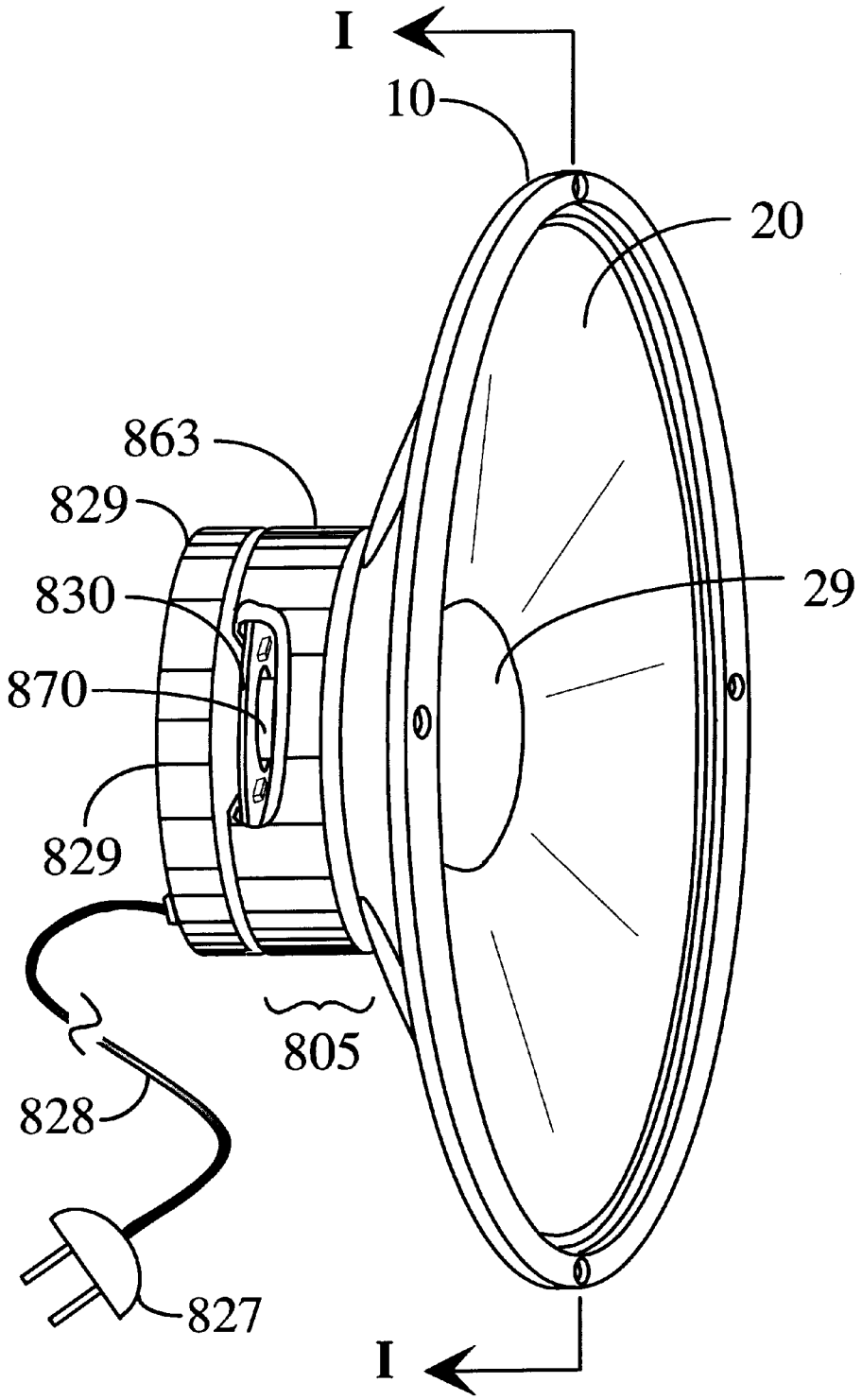
FIG. 31 is an overall isometric view of a ninth embodiment of the present invention.

Also shown in this embodiment of the present invention is a piggy-back power supply, 825, with power cord, 828, and power plug, 827, and cover, 829. The power supply, 825, is mounted on the back of magnetic assembly, 705, with cover, 829, attached. FIG. 29 is a schematic representation showing power supply, 825, powering optical interface, 221, and amplifier circuit, 731. This configuration also provides a plug-in-the-wall-device marketable to the end consumer not requiring traditional copper speaker wire connections.

A ninth sample embodiment, shown in FIG. 31, FIG. 32, FIG. 33, and FIG. 34, illustrates an amplified loudspeaker where a network interface, 823, and amplifier circuit, 831, are now mounted on the inside rear wall of the loudspeaker's magnetic assembly, 805. This network interface, 823, in this particular embodiment is made up of network controller, 822, configuration EEPROM, 819, and audio signal decoder, 821. In this particular embodiment of a network interface, the amplified loudspeaker receives an encoded digital data signal transmitted by a remote networking device over the ac power lines. The incoming encoded digital data signal reaches piggy-back power supply, 925, through power plug, 827, and power cord, 828. Power Interface, 923, extracts the incoming encoded digital data signal received and passes it to network interface, 823, via network link, 824. Generally, network link, 824, is passed through connector, 826, in magnetic assembly, 805, which also provides power to network interface, 823, and amplifier circuit, 831. The network based amplifier circuit, 830, is electrically coupled through tinsel wires, 125, and inductive components, 40, to voice coil, 45, which also resides within magnetic assembly, 805.

Figure 33:
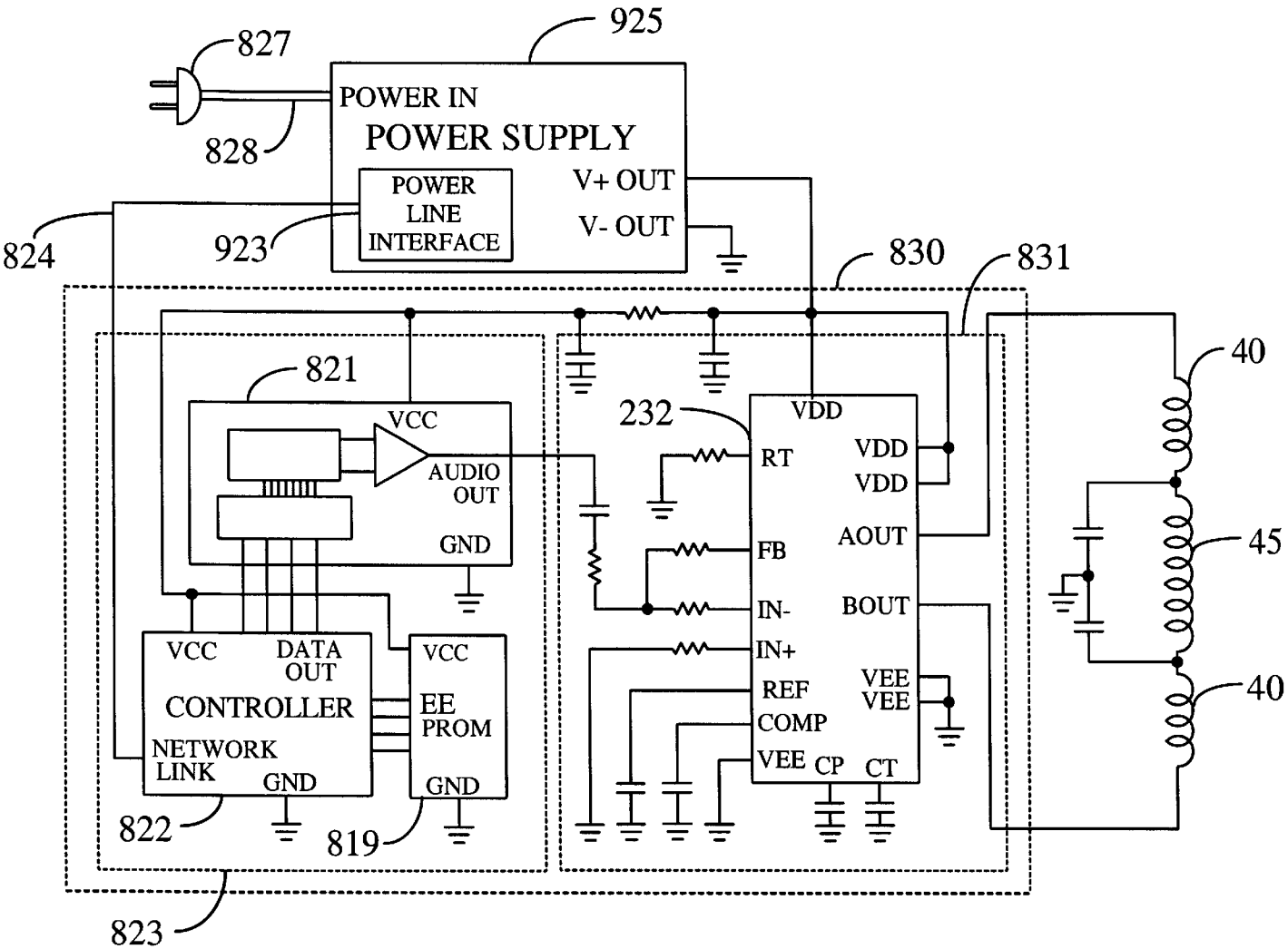
FIG. 33 is a schematic representation of the electronic circuitry according to the ninth embodiment of the present invention.
Figure 34:
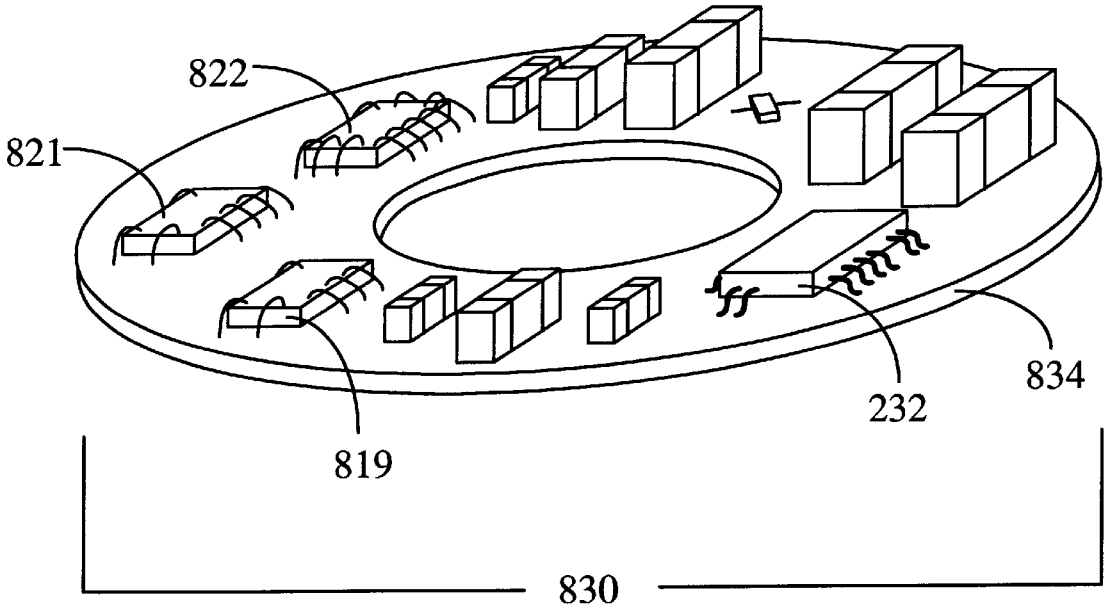
FIG. 34 is an isometric view of the network interface and amplifier circuit according to the ninth embodiment of the present invention.

As in previous embodiments of the present invention, the power supply, 925, is mounted on the back of magnetic assembly, 805, with cover, 829, attached. FIG. 33 is a schematic representation showing power supply, 925, powering network interface, 823, and amplifier circuit, 831. This networked configuration provides a plug-in-the-wall-device marketable to the end consumer requiring no traditional speaker wire or audio signal connection needed. To those in the art, it is clear that a plurality of networked based embodiments of the present invention are feasible which are hereby incorporated by reference. Other such embodiments are not be merely limited to ac power line based networking links but may utilize alternate network connection techniques such as radio-frequency(RF), optical, or network cabling means for transmitting the encoded digital network signal. This more preferred sample embodiment was chosen to illustrate a low cost network interface that does not require additional cabling of any type and also does not require a more expensive radio-frequency (RF) interface.

Figure 32:
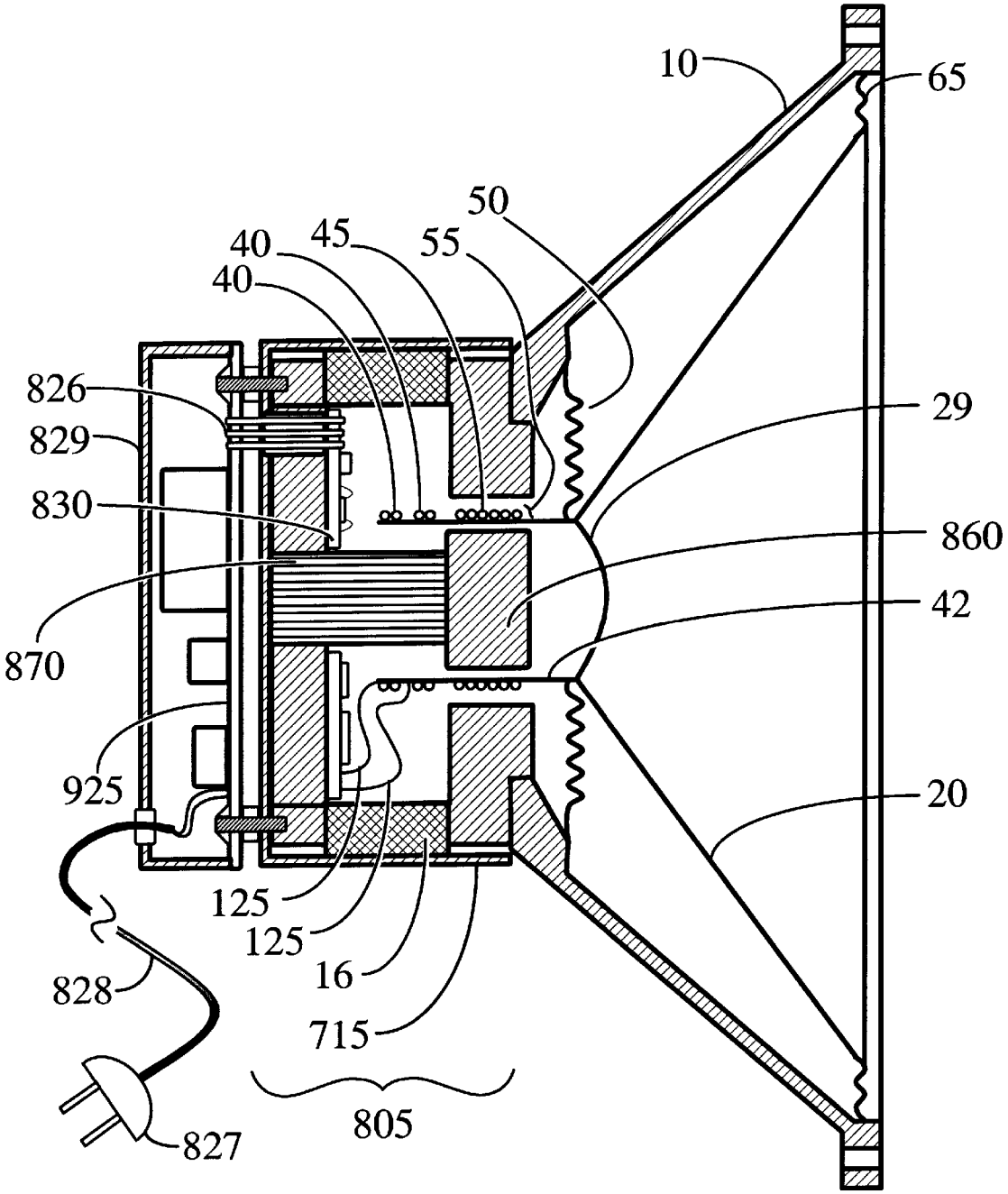
FIG. 32 is a cross sectional view of the ninth embodiment of the present invention through section II.

In this ninth embodiment of the present invention, the center pole is shown as being split into two pieces, 870, and 860. The center pole piece, 860, is manufactured of conventional ferro-magnetic material, such as iron, etc. The second center pole piece, 870, is shown in FIG. 32 as being manufactured of a laminated iron or steel type material. This serves to further illustrate that in higher power speaker assemblies, the eddy current losses associated with solid single center pole pieces, such as the pole piece, 60, shown in FIG. 9 of the third embodiment, are reduced.

Figure 35:
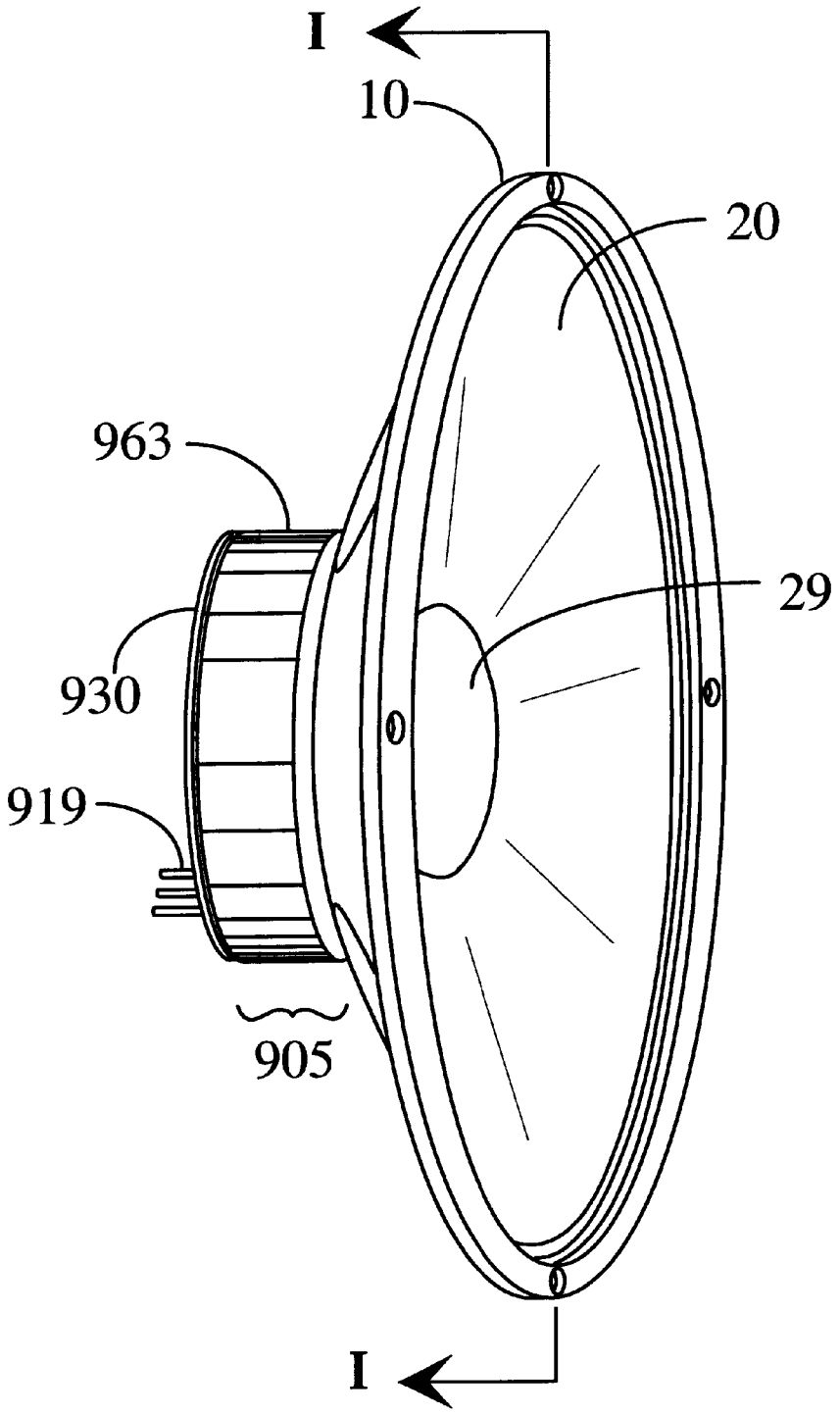
FIG. 35 is an overall isometric view of a tenth embodiment of the present invention.
Figure 36:
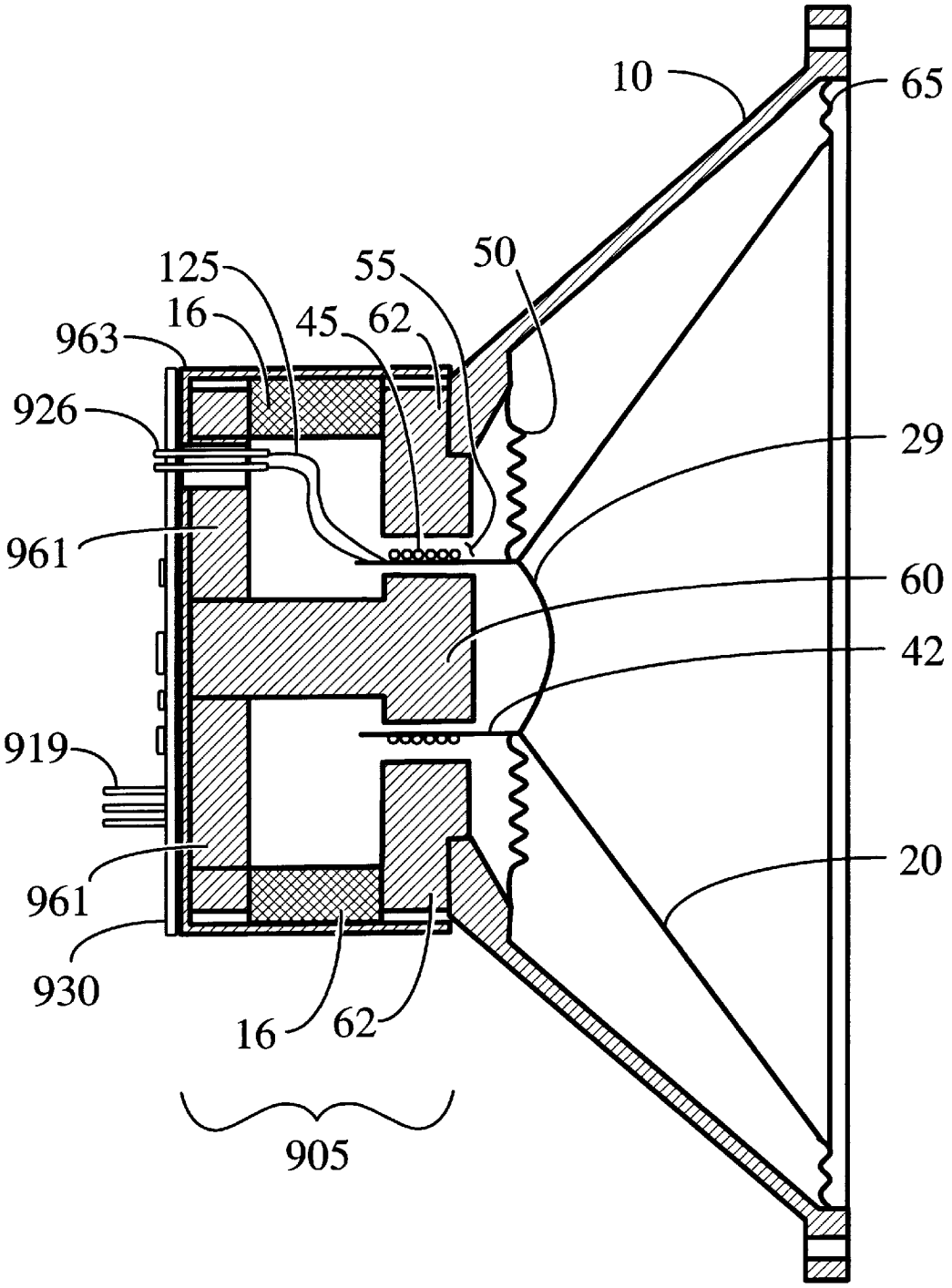
FIG. 36 is a cross sectional view of the tenth embodiment of the present invention through section II.
Figure 37:
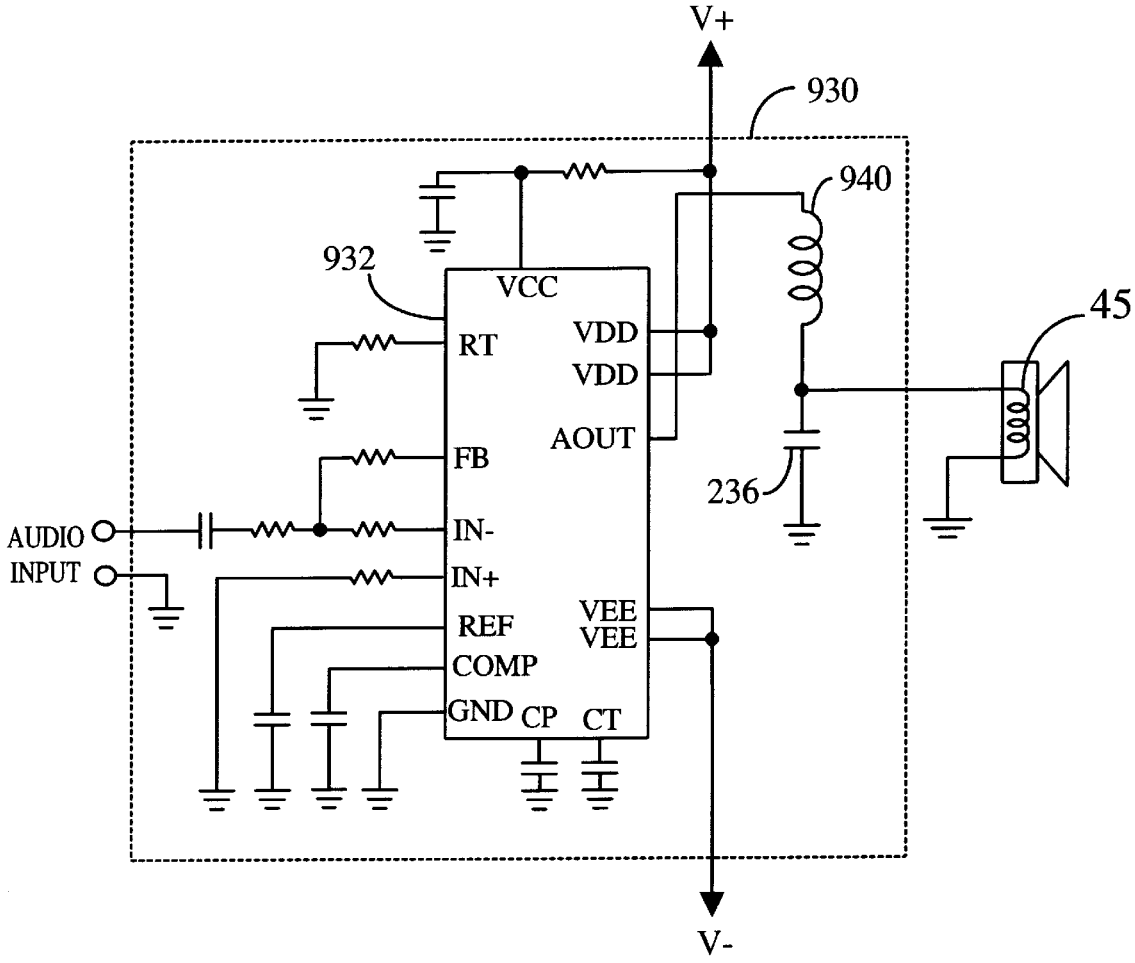
FIG. 37 is a schematic representation of the electronic circuitry according to the tenth embodiment of the present invention.

A tenth embodiment of the present invention is illustrated in FIG. 35, FIG. 36, and FIG. 37, in which a class D amplifier circuit, 930, with external inductive and capacitive (LC) filtering, is externally mounted on the back side of magnetic assembly, 905. Integrated circuit, 932, making up a portion of amplifier circuit, 930, is designed with a single ended output requiring only one inductive component, 940, and one capacitive component, 236. This circuit, however, requires an additional (negative) supply.

Connection to voice coil, 45, is made by way of tinsel wires, 125, through connector, 926, to amplifier circuit, 930. External power and input audio signal is provided to the amplified loudspeaker assembly through connector, 919. This embodiment shows the present invention in one of its simplest forms which proves to be very useful in that it fully shields the connection to voice coil, 45, from amplifier circuit, 930, such that any residual EMI radiation is further shielded by magnetic assembly, 905.

Figure 38:
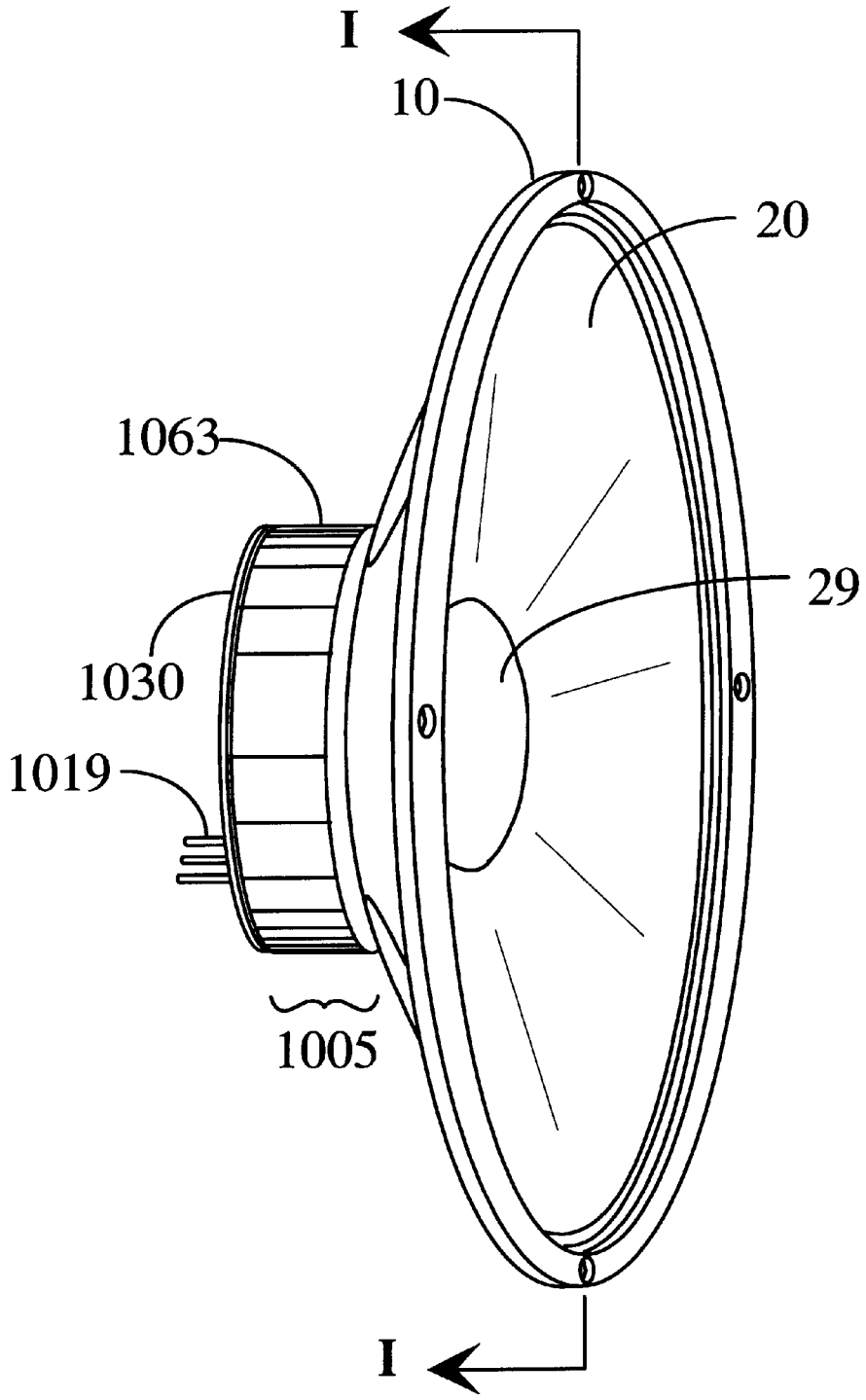
FIG. 38 is an overall isometric view of a eleventh embodiment of the present invention.
Figure 39:
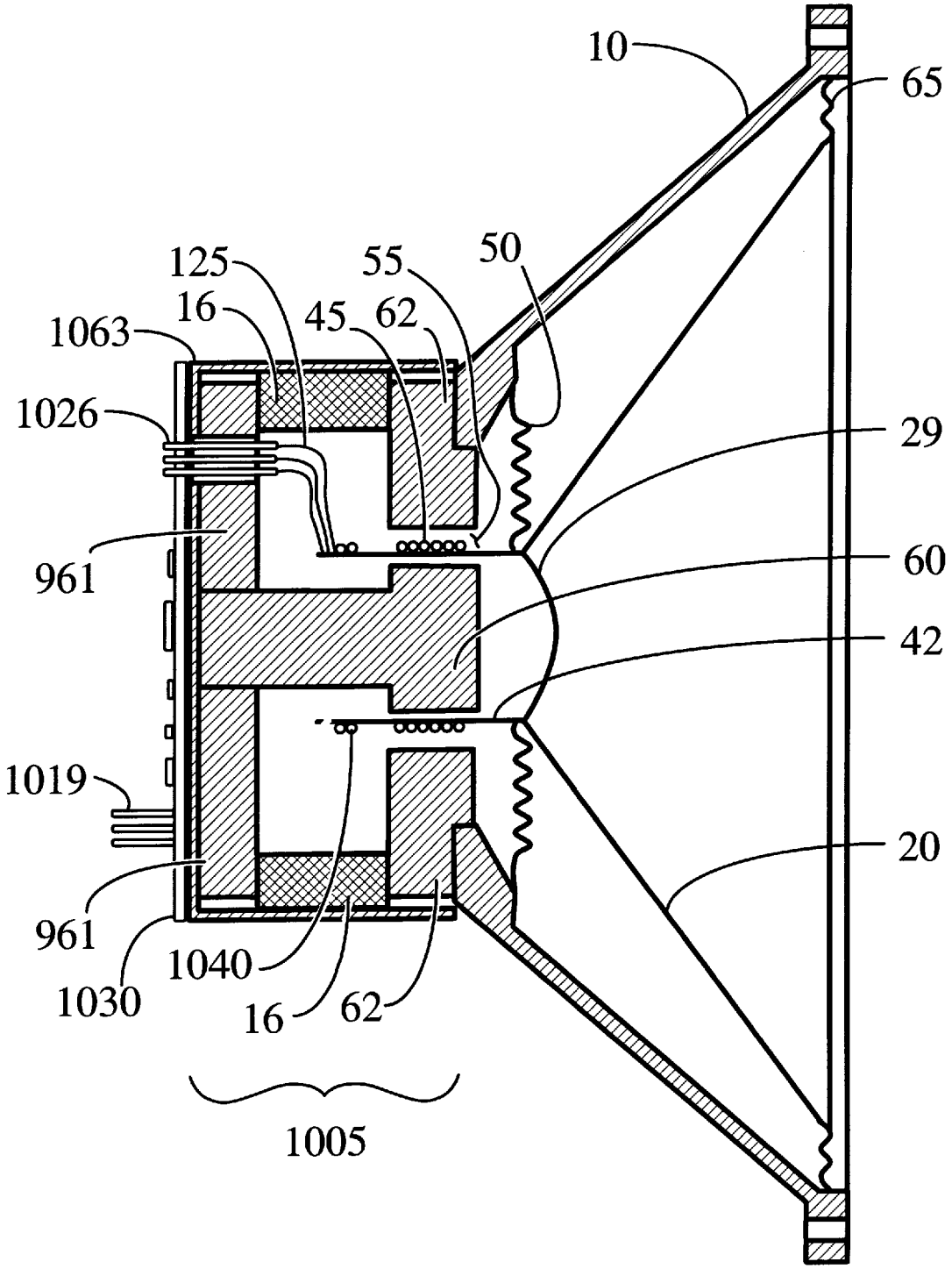
FIG. 39 is a cross sectional view of the eleventh embodiment of the present invention through section II.
Figure 40:
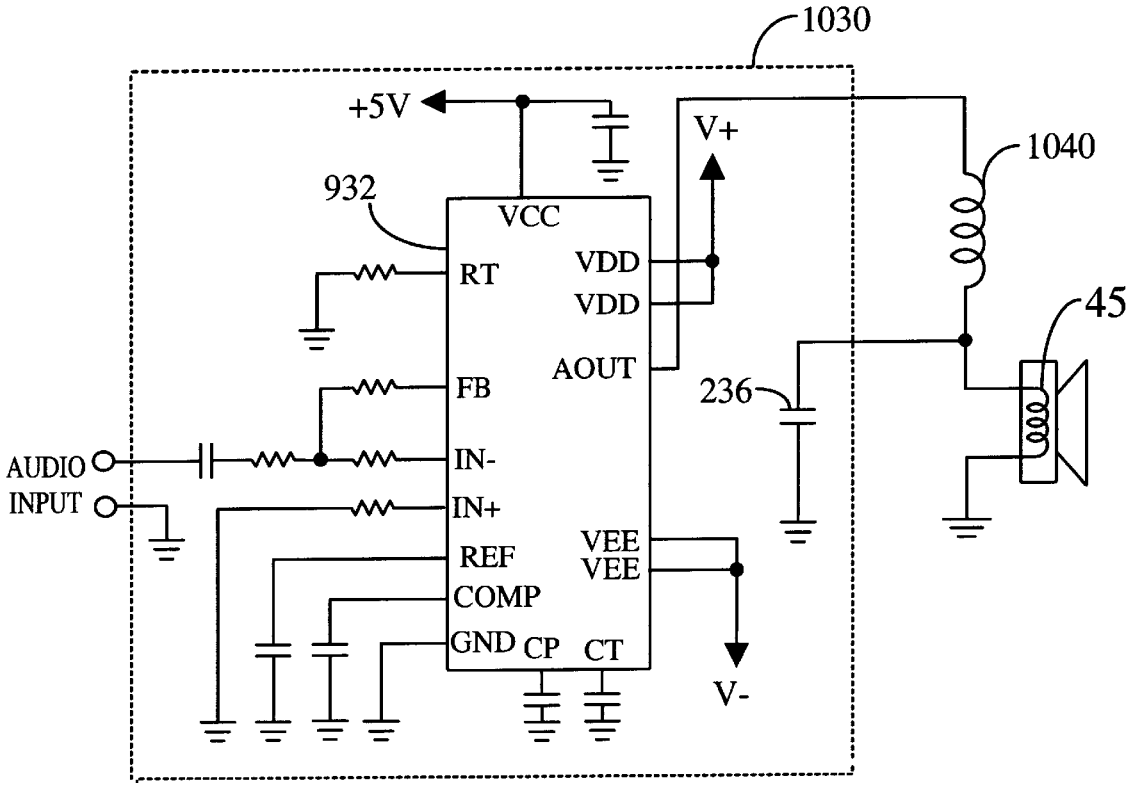
FIG. 40 is a schematic representation of the electronic circuitry according to the eleventh embodiment of the present invention.

FIG. 38, FIG. 39, and FIG. 40 illustrate an eleventh embodiment of the present invention which is a clone of the tenth embodiment with the exception that inductive component, 940, has been replaced inductive component, 1040, which now resides inside of magnetic assembly, 1005 and has been wound onto former, 42. As mentioned in previous embodiments, the placing of inductive component, 1040, inside of magnetic assembly, 1005, provides better EMI shielding than those embodiments in which an inductive component remains external.

Although two different magnetic assemblies have been used throughout the eleven sample embodiments of the present invention for illustrative purposes, numerous other magnetic assemblies known in the loudspeaker industry could also be used in any embodiment of the present invention and are hereby incorporated by reference.

Although other types of amplification stages could have been chosen, a class D embodiment is shown for its high power efficiency and the extra difficulties which must be overcome in its application. The difficulties of class D amplifier application center around its switching nature and the resulting filter and EMI suppression burdens imposed by the design. One of the important features of the present invention is its ability to address and solve both problems by the nature of the assembly design and enclosure techniques disclosed.

In the context of the present invention disclosed herewith, the term amplifier circuit is intended to encompass not only traditional amplifier circuitry but also feedback amplifier circuitry, amplifier circuitry utilizing digital signal processing(DSP) techniques, amplifier circuitry utilizing voice coil burnout protection circuitry, as well as other types of appropriate amplifier circuitry known to the art, which are hereby incorporated by reference.

The term referring to an inductive component is intended to encompass not only inductors, transformers, ferrite beads, chokes and/or transformers but also coils of wound wire, tinsel wire, bare wires in free space, circular traces on a printed circuit board, hybrid device substrate and/or any other type of substrate, as well as, any one, any combination, or any combination containing a multiple of any one or more of these items. It is further understood that an inductive component interpreted in this manner enumerates a large number of possible inductive configurations that can also be used in any embodiment of the present invention and are hereby incorporated by reference.

SUMMARY, RAMIFICATIONS, AND SCOPE

Accordingly the reader will see that the integrating of an amplifier and other related circuitry onto or within the actual parts of a loudspeaker provide many advantages. Primary among them is the lowering of the cost of manufacturing the amplifier, receiver and loudspeaker assembly because many of the components no longer need individual packaging since they are in protected areas.

The amplified loudspeaker of the present invention also has the ability to both shield and minimize EMI inherent in class D amplifier design through reducing wire length and shielding components within the cavity of the magnetic assembly. With the voice coil and driver electronics being able to be placed in close proximity allows for optimal matching of the amplifier/driver electronics to the characteristic of the loudspeaker's voice coil, the elimination of heavy gage speaker wires, and the realization of near zero length electronic voice coil connections.

In the first, third, fifth, and seventh, sample embodiments of the present invention, the electronic circuitry shares the former with the voice coil. These form a part of the loudspeaker's moving assembly and thus generate an air turbulence which cools the various electronic components mounted on the former eliminating the need for separate heat sinks. In the second, fourth, sixth, eighth, ninth, tenth and eleventh embodiments, once again the need for heat sinking is eliminated by the thermal bonding of the substrates containing electronic circuitry to an inner and or outer wall of the magnetic assembly where conduction cooling to the mass of the loudspeaker's magnetic assembly can be exploited. This results in further cost reduction in the manufacture of the present invention.

Although the description above contains many specificities, these should not be construed as limiting the scope of the invention but as merely providing illustrations of some of the presently preferred embodiments of this invention. Thus the scope of the invention should be determined by the appended claims and their legal equivalents rather than by the examples provided.

What is claimed is:

1. A loudspeaker device comprising:

a magnetic assembly having a magnetic gap;

a former;

a voice coil wound around said former and positioned in said magnetic gap;

a first inductive component wound around a portion of said former positioned outside of said magnetic gap and electrically coupled in series with said voice coil;

a substrate mounted on said former, said substrate comprising a layer of thermally conductive material, and a layer of electrically conductive traces; and an amplifier circuit thermally coupled to said layer of thermally conductive material, said amplifier circuit comprising an input and a first output, wherein said first output of said amplifier circuit is electrically coupled to said voice coil through said first inductive component.

2. The loudspeaker device of claim 1 wherein said layer of thermally conductive material comprises aluminum.

3. The loudspeaker device of claim 1 wherein said layer of thermally conductive material comprises beryllium.

4. The loudspeaker device of claim 1 wherein said amplifier circuit comprises at least one integrated circuit.

5. The loudspeaker device of claim 1 wherein said amplifier circuit comprises a class D amplifier.

6. A loudspeaker device comprising:

a magnetic assembly having a magnetic gap;

a former;

a voice coil wound around said former and positioned in said magnetic gap;

a first inductive component wound around a portion of said former positioned outside of said magnetic gap and electrically coupled in series with said voice coil;

a second inductive component a) wound around a portion of said former positioned outside of said magnetic gap, b) electrically coupled in series with said voice coil and c) electrically coupled to said first inductive component through said voice coil;

a first capacitive component electrically coupled between said first inductive component and said voice coil;

a second capacitive component electrically coupled between said second inductive component and said voice coil;

a substrate mounted on said former, said substrate comprising a layer of thermally conductive material, and a layer of electrically conductive traces; and an amplifier circuit thermally coupled to said layer of thermally conductive material and comprising an input, a first output and a second output, wherein said first output of said amplifier circuit is electrically coupled to said voice coil through said first inductive component and said second output of said amplifier circuit is electrically coupled to said voice coil through said second inductive component.

7. The loudspeaker device of claim 6 wherein said layer of thermally conductive material comprises aluminum.

8. The loudspeaker device of claim 6 wherein said layer of thermally conductive material comprises beryllium.

9. The loudspeaker device of claim 6 wherein said amplifier circuit comprises an integrated circuit.

10. The loudspeaker device of claim 6 wherein said amplifier circuit comprises a class D amplifier.

11. A loudspeaker device comprising:

a magnetic assembly having a magnetic gap;

a former;

a voice coil wound around said former and positioned in said magnetic gap;

a first inductive component wound around a portion of said former positioned outside of said magnetic gap and electrically coupled in series with said voice coil;

a second inductive component a) wound around a portion of said former positioned outside of said magnetic gap, b) electrically coupled in series with said voice coil and c) electrically coupled to said first inductive component through said voice coil;

a substrate mounted on said former, said substrate comprising a layer of thermally conductive material, and a layer of electrically conductive traces; and an amplifier circuit thermally coupled to said layer of thermally conductive material and comprising an input, a first output and a second output, wherein said first output of said amplifier circuit is electrically coupled to said voice coil through said first inductive component and said second output of said amplifier circuit is electrically coupled to said voice coil through said second inductive component.

12. The loudspeaker device of claim 11 wherein said layer of thermally conductive material comprises aluminum.

13. The loudspeaker device of claim 11 wherein said layer of thermally conductive material comprises beryllium.

14. The loudspeaker device of claim 11 wherein said amplifier circuit comprises an integrated circuit.

15. The loudspeaker device of claim 11 wherein said amplifier circuit comprises a class D amplifier.

16. A loudspeaker device comprising:

a magnetic assembly having a magnetic gap;

a former;

a voice coil wound around said former and positioned in said magnetic gap;

a substrate mounted on said former, said substrate comprising a layer of thermally conductive material, and a layer of electrically conductive traces; and an amplifier circuit thermally coupled to said layer of thermally conductive material and comprising an input and a first output, wherein said first output of said amplifier circuit is electrically coupled to said voice coil.

17. The loudspeaker device of claim 16 further comprising a power supply mounted on at least one surface of said magnetic assembly and electrically coupled to said amplifier circuit.

18. The loudspeaker device of claim 16 further comprising a radio frequency receiver mounted on said substrate and including an output electrically coupled to said input of said amplifier circuit.

19. The loudspeaker device of claim 18 further comprising a power supply mounted on at least one surface of said magnetic assembly and electrically coupled to said amplifier circuit and to said radio frequency receiver.

20. The loudspeaker device of claim 16 further comprising:

an optical interface mounted on said substrate, said optical interface including an output and a non fiber coupled optical sensor, wherein said input of said amplifier circuit is electrically coupled to said output of said optical interface.

21. The loudspeaker device of claim 20 further comprising a power supply mounted on at least one surface of said magnetic assembly and electrically coupled to said amplifier circuit and to said optical interface.

22. The loudspeaker device of claim 16 further comprising a radio frequency receiver mounted on at least one surface of said magnetic assembly and including an output electrically coupled to said input of said amplifier circuit.

23. The loudspeaker device of claim 22 further comprising a power supply mounted on at least one surface of said magnetic assembly and electrically coupled to said amplifier circuit and to said radio frequency receiver.

24. The loudspeaker device of claim 16 further comprising an optical interface mounted on at least one surface of said magnetic assembly and including an output electrically coupled to said input of said amplifier circuit.

25. The loudspeaker device of claim 24 further comprising a power supply mounted on at least one surface of said magnetic assembly and electrically coupled to said amplifier circuit and to said optical interface.

26. The loudspeaker device of claim 16 further comprising a network interface mounted on at least one surface of said magnetic assembly and including an output electrically coupled to said input of said amplifier circuit.

27. The loudspeaker device of claim 26 further comprising a power supply mounted on at least one surface of said magnetic assembly and electrically coupled to said amplifier circuit and to said network interface.

28. The loudspeaker device of claim 16 further comprising a first inductive component electrically coupled to said first output of said amplifier circuit and wound around a portion of said former positioned outside of said magnetic gap.

29. The loudspeaker device of claim 28 further comprising a power supply mounted on at least one surface of said magnetic assembly and electrically coupled to said amplifier circuit.

30. The loudspeaker device of claim 28 further comprising a radio frequency receiver mounted on said substrate and including an output electrically coupled to said input of said amplifier circuit.

31. The loudspeaker device of claim 30 further comprising a power supply mounted on at least one surface of said magnetic assembly and electrically coupled to said amplifier circuit and to said radio frequency receiver.

32. The loudspeaker device of claim 28 further comprising:

an optical interface mounted on said substrate, said optical interface including an output and a non fiber coupled optical sensor, wherein said input of said amplifier circuit is electrically coupled to said output of said optical interface.

33. The loudspeaker device of claim 32 further comprising a power supply mounted on at least one surface of said magnetic assembly and electrically coupled to said amplifier circuit and to said optical interface.

34. The loudspeaker device of claim 28 further comprising a radio frequency receiver mounted on at least one surface of said magnetic assembly and including an output electrically coupled to said input of said amplifier circuit.

35. The loudspeaker device of claim 34 further comprising a power supply mounted on at least one surface of said magnetic assembly and electrically coupled to said amplifier circuit and to said radio frequency receiver.

36. The loudspeaker device of claim 28 further comprising an optical interface mounted on at least one surface of said magnetic assembly and including an output electrically coupled to said input of said amplifier circuit.

37. The loudspeaker device of claim 36 further comprising a power supply mounted on at least one surface of said magnetic assembly and electrically coupled to said amplifier circuit and to said optical interface.

38. The loudspeaker device of claim 28 further comprising a network interface mounted on at least one surface of said magnetic assembly and including an output electrically coupled to said input of said amplifier circuit.

39. The loudspeaker device of claim 38 further comprising a power supply mounted on at least one surface of said magnetic assembly and electrically coupled to said amplifier circuit and to said network interface.

40. The loudspeaker device of claim 28 further comprising:

a second inductive component wound around a portion of said former positioned outside of said magnetic gap and electrically coupled to said voice coil, wherein said amplifier circuit comprises a second output that is electrically coupled to said second inductive component.

41. The loudspeaker device of claim 40 further comprising a power supply mounted on at least one surface of said magnetic assembly and electrically coupled to said amplifier circuit.

42. The loudspeaker device of claim 40 further comprising a radio frequency receiver mounted on said substrate and including an output electrically coupled to said input of said amplifier circuit.

43. The loudspeaker device of claim 42 further comprising a power supply mounted on at least one surface of said magnetic assembly and electrically coupled to said amplifier circuit and to said radio frequency receiver.

44. The loudspeaker device of claim 40 further comprising:

an optical interface mounted on said substrate, said optical interface including an output and a non fiber coupled optical sensor, wherein said input of said amplifier circuit is electrically coupled to said output of said optical interface.

45. The loudspeaker device of claim 44 further comprising a power supply mounted on at least one surface of said magnetic assembly and electrically coupled to said amplifier circuit and to said optical interface.

46. The loudspeaker device of claim 40 further comprising a radio frequency receiver mounted on at least one surface of said magnetic assembly and including an output electrically coupled to said input of said amplifier circuit.

47. The loudspeaker device of claim 46 further comprising a power supply mounted on at least one surface of said magnetic assembly and electrically coupled to said amplifier circuit and to said radio frequency receiver.

48. The loudspeaker device of claim 40 further comprising an optical interface mounted on at least one surface of said magnetic assembly and including an output electrically coupled to said input of said amplifier circuit.

49. The loudspeaker device of claim 48 further comprising a power supply mounted on at least one surface of said magnetic assembly and electrically coupled to said amplifier circuit and to said optical interface.

50. The loudspeaker device of claim 40 further comprising a network interface mounted on at least one surface of said magnetic assembly and including an output electrically coupled to said input of said amplifier circuit.

51. The loudspeaker device of claim 50 further comprising a power supply mounted on at least one surface of said magnetic assembly and electrically coupled to said amplifier circuit and to said network interface.

52. The loudspeaker device of claim 16 wherein said layer of thermally conductive material comprises aluminum.

53. The loudspeaker device of claim 16 wherein said layer of thermally conductive material comprises beryllium.

54. The loudspeaker device of claim 16 wherein said amplifier circuit comprises a second output that is electrically coupled to said voice coil.

55. The loudspeaker device of claim 16 wherein said amplifier circuit comprises a linear amplifier.

56. The loudspeaker device of claim 55 wherein said linear amplifier is a class B amplifier.

57. The loudspeaker device of claim 16 wherein said amplifier circuit comprises a class D amplifier.

58. A loudspeaker device comprising:

a magnetic assembly having a magnetic gap;

a former;

a voice coil wound around said former and positioned in said magnetic gap;

a substrate mounted on at least one inside surface of said magnetic assembly, said sustrate comprising a layer of thermally conductive material, and a layer of electrically conductive traces; and an amplifier circuit a) residing inside of said magnetic assembly, b) thermally coupled to said layer of thermally conductive material c) comprising an input, and d) comprising a first output electrically coupled to said voice coil.

59. The loudspeaker device of claim 58 further comprising a power supply mounted on at least one surface of said magnetic assembly and electrically coupled to said amplifier circuit.

60. The loudspeaker device of claim 58 further comprising a radio frequency receiver mounted on said former and including an output electrically coupled to said input of said amplifier circuit.

61. The loudspeaker device of claim 60 further comprising a power supply mounted on at least one surface of said magnetic assembly and electrically coupled to said amplifier circuit and to said radio frequency receiver.

62. The loudspeaker device of claim 58 further comprising an optical interface mounted on said former, said optical interface including an output and a non fiber coupled optical sensor, wherein said input of said amplifier circuit is electrically coupled to said output of said optical interface.

63. The loudspeaker device of claim 62 further comprising a power supply mounted on at least one surface of said magnetic assembly and electrically coupled to said amplifier circuit and to said optical interface.

64. The loudspeaker device of claim 58 further comprising a radio frequency receiver mounted on at least one surface of said magnetic assembly and including an output electrically coupled to said input of said amplifier circuit.

65. The loudspeaker device of claim 64 further comprising a power supply mounted on at least one surface of said magnetic assembly and electrically coupled to said amplifier circuit and to said radio frequency receiver.

66. The loudspeaker device of claim 58 further comprising an optical interface mounted on at least one surface of said magnetic assembly and including an output electrically coupled to said input of said amplifier circuit.

67. The loudspeaker device of claim 66 further comprising a power supply mounted on at least one surface of said magnetic assembly and electrically coupled to said amplifier circuit and to said optical interface.

68. The loudspeaker device of claim 58 further comprising a network interface mounted on at least one surface of said magnetic assembly and including an output electrically coupled to said input of said amplifier circuit.

69. The loudspeaker device of claim 68 further comprising a power supply mounted on at least one surface of said magnetic assembly and electrically coupled to said amplifier circuit and to said network interface.

70. The loudspeaker device of claim 58 further comprising:

a first inductive component electrically coupled to said first output of said amplifier circuit and wound around a portion of said former positioned outside of said magnetic gap.

71. The loudspeaker device of claim 70 further comprising a power supply mounted on at least one surface of said magnetic assembly and electrically coupled to said amplifier circuit.

72. The loudspeaker device of claim 70 further comprising a radio frequency receiver mounted on said former and including an out-put electrically coupled to said input of said amplifier circuit.

73. The loudspeaker device of claim 72 further comprising a power supply mounted on at least one surface of said magnetic assembly and electrically coupled to said amplifier circuit and to said radio frequency receiver.

74. The loudspeaker device of claim 70 further comprising:

an optical interface mounted on said former, said optical interface including an output and a non fiber coupled optical sensor, wherein said input of said amplifier circuit is electrically coupled to said output of said optical interface.

75. The loudspeaker device of claim 74 further comprising a power supply mounted on at least one surface of said magnetic assembly and electrically coupled to said amplifier circuit and to said optical interface.

76. The loudspeaker device of claim 70 further comprising a radio frequency receiver mounted on at least one surface of said magnetic assembly and including an output electrically coupled to said input of said amplifier circuit.

77. The loudspeaker device of claim 76 further comprising a power supply mounted on at least one surface of said magnetic assembly and electrically coupled to said amplifier circuit and to said radio frequency receiver.

78. The loudspeaker device of claim 70 further comprising an optical interface mounted on at least one surface of said magnetic assembly and including an output electrically coupled to said input of said amplifier circuit.

79. The loudspeaker device of claim 78 further comprising a power supply mounted on at least one surface of said magnetic assembly and electrically coupled to said amplifier circuit and to said optical interface.

80. The loudspeaker device of claim 70 further comprising a network interface mounted on at least one surface of said magnetic assembly and including an output electrically coupled to said input of said amplifier circuit.

81. The loudspeaker device of claim 80 further comprising a power supply mounted on at least one surface of said magnetic assembly and electrically coupled to said amplifier circuit and to said network interface.

82. The loudspeaker device of claim 70 further comprising:

a second inductive component wound around a portion of said former positioned outside of said magnetic gap and electrically coupled to said voice coil, wherein said amplifier circuit comprises a second output that is electrically coupled to said second inductive component.

83. The loudspeaker device of claim 82 further comprising a power supply mounted on at least one surface of said magnetic assembly and electrically coupled to said amplifier circuit.

84. The loudspeaker device of claim 82 further comprising a radio frequency receiver mounted on said former and including an output electrically coupled to said input of said amplifier circuit.

85. The loudspeaker device of claim 84 further comprising a power supply mounted on at least one surface of said magnetic assembly and electrically coupled to said amplifier circuit and to said radio frequency receiver.

86. The loudspeaker device of claim 82 further comprising: an optical interface mounted on said former, said optical interface including an output and a non fiber coupled optical sensor, wherein said input of said amplifier circuit is electrically coupled to said output of said optical interface.

87. The loudspeaker device of claim 86 further comprising a power supply mounted on at least one surface of said magnetic assembly and electrically coupled to said amplifier circuit and to said optical interface.

88. The loudspeaker device of claim 82 further comprising a radio frequency receiver mounted on at least one surface of said magnetic assembly and including an output electrically coupled to said input of said amplifier circuit.

89. The loudspeaker device of claim 88 further comprising a power supply mounted on at least one surface of said magnetic assembly and electrically coupled to said amplifier circuit and to said radio frequency receiver.

90. The loudspeaker device of claim 82 further comprising an optical interface mounted on at least one surface of said magnetic assembly and including an output electrically coupled to said input of said amplifier circuit.

91. The loudspeaker device of claim 90 further comprising a power supply mounted on at least one surface of said magnetic assembly and electrically coupled to said amplifier circuit and to said optical interface.

92. The loudspeaker device of claim 82 further comprising a network interface mounted on at least one surface of said magnetic assembly and including an output electrically coupled to said input of said amplifier circuit.

93. The loudspeaker device of claim 92 further comprising a power supply mounted on at least one surface of said magnetic assembly and electrically coupled to said amplifier circuit and to said network interface.

94. The loudspeaker device of claim 58 wherein said layer of thermally conductive material comprises aluminum.

95. The loudspeaker device of claim 58 wherein said layer of thermally conductive material comprises beryllium.

96. The loudspeaker device of claim 58 wherein said amplifier circuit comprises a linear amplifier.

97. The loudspeaker device of claim 58 wherein said amplifier circuit comprises a class D amplifier.

98. A method for convection cooling an amplifier circuit, including an input and an output, in a loudspeaker device utilizing a) a magnetic assembly having a magnetic gap with an associated magnetic field and b) a voice coil wound around a former and positioned in said magnetic gap, said method comprising the steps of:

mounting a substrate on said former, said substrate comprising a layer of thermally conductive material, and a layer of electrically conductive traces;

thermally coupling said amplifier circuit to said layer of thermally conductive material; and electrically coupling said output of said amplifier to said voice coil;

whereby said former, said voice coil, said substrate and said amplifier circuit move in response to a voltage applied by said output of said amplifier circuit to said voice coil interacting with said magnetic field resulting in said convection cooling of said amplifier circuit.

99. A method for conductive cooling of an amplifier circuit in a loudspeaker device utilizing a) a magnetic assembly having a magnetic gap with an associated magnetic field and b) a voice coil wound around a former and positioned in said magnetic gap, said method comprising the steps of:

mounting a substrate on at least one inside surface of said magnetic assembly, said substrate comprising a layer of thermally conductive material, and a layer of electrically conductive traces; and thermally coupling said amplifier circuit to said layer of thermally conductive material whereby said layer of thermally conductive material conductively transfers a portion of said heat generated by said amplifier circuit to said inside surface of said magnetic assembly for transfer to said outside surface of said magnetic assembly.

100. A method for fully integrating an amplifier circuit, including an input and an output, in a loudspeaker device utilizing a) a former, b) a magnetic assembly having a magnetic gap and c) a voice coil wound around said former and positioned in said magnetic gap comprising the steps of:

mounting a substrate on said former, said substrate comprising a layer of thermally conductive material, and a layer of electrically conductive traces; and thermally coupling said amplifier circuit to said layer of thermally conductive material and electrically coupling said output of said amplifier circuit to said voice coil.

* * * * *